US007597415B2

(12) United States Patent
Sugahara

(10) Patent No.: US 7,597,415 B2
(45) Date of Patent: Oct. 6, 2009

(54) LIQUID-DROPLET JETTING APPARATUS HAVING A SERIAL AUXILIARY HEAD

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 219 days.

(21) Appl. No.: 11/534,447

(22) Filed: Sep. 22, 2006

(65) Prior Publication Data

US 2007/0064042 A1 Mar. 22, 2007

(30) Foreign Application Priority Data

Sep. 22, 2005 (JP) ..... 2005-276002

(51) Int. Cl.
*B41J 29/38* (2006.01)
*B41J 29/393* (2006.01)
*B41J 2/145* (2006.01)
*B41J 2/165* (2006.01)

(52) U.S. Cl. ..... 347/13; 347/19; 347/23; 347/40

(58) Field of Classification Search ..... 347/19, 347/49

See application file for complete search history.

(56) References Cited

U.S. PATENT DOCUMENTS 5,398,053 A * 3/1995 Hirosawa et al. ..... 347/19
5,574,485 A * 11/1996 Anderson et al. ..... 347/27
5,587,730 A * 12/1996 Karz ..... 347/43
5,627,571 A * 5/1997 Anderson et al. ..... 347/19
5,796,416 A * 8/1998 Silverbrook ..... 347/47
5,838,343 A * 11/1998 Chapin et al. ..... 347/22
6,481,820 B1 11/2002 Tamura et al.
6,641,251 B1 * 11/2003 Rodriguez ..... 347/43
6,663,215 B2 * 12/2003 Klausbruckner et al. ..... 347/22
2006/0227157 A1 * 10/2006 Drake et al. ..... 347/19

FOREIGN PATENT DOCUMENTS

JP 1999334047 A 12/1999
JP 2005088417 A 4/2005

* cited by examiner

*Primary Examiner*—Matthew Luu
*Assistant Examiner*—Shelby Fidler
(74) *Attorney, Agent, or Firm*—Baker Botts, LLP

(57) ABSTRACT

An ink-jet printer has a line-type ink-jet head which has a nozzle row including a plurality of nozzles arranged in an array in a scanning direction; an auxiliary head which is movable in the scanning direction and which has a plurality of nozzles arranged in an array in the scanning direction, and a pitch at which the nozzles of the nozzle row are arranged in the ink-jet head and a pitch at which the nozzles are arranged in the auxiliary head are same. Accordingly, when jetting failure occurs concurrently at nozzles among the plurality of nozzles in the ink-jet head, it is possible to complement, at one time, the failed nozzles by the nozzles in the auxiliary head.

11 Claims, 22 Drawing Sheets

LIQUID-DROPLET JETTING APPARATUS HAVING A SERIAL AUXILIARY HEAD

CROSS REFERENCE TO RELATED APPLICATION

The present application claims priority from Japanese Patent Application No. 2005-276002 filed on Sep. 22, 2005, the disclosure of which is incorporated herein by reference in its entirety.

BACKGROUND OF THE INVENTION

1. Field of the Invention

The present invention relates to a liquid-droplet jetting apparatus which jets liquid droplets.

2. Description of the Related Art

As an ink-jet printer which jets an ink onto a recording paper or the like, there is known an ink-jet printer having an ink-jet head of line type (line-type ink-jet head) provided with a plurality of nozzles arranged in an array in a direction orthogonal to a feeding direction of the recording paper or the like. The line-type ink-jet head has an advantage that the line-type ink-jet head performs printing faster than an ink-jet head of serial type, because the line-type ink-jet head is capable of jetting ink from the nozzles arranged in a line entirely in the width of the recording paper to perform the printing. On the other hand, since the line-type ink-head has a large number of nozzles, when dust, air, and/or the like enter in any of the nozzles, jetting failure is easily occur such that the liquid droplet cannot be jetted (misfiring or non-discharge of liquid droplet); a liquid droplet of the ink is jetted in a direction deviated or bent from an intended direction (bending in the jetting direction), which in turn causes the liquid droplet land on a position deviated from an intended landing position; and the like. When such a jetting abnormality occurs, a while streak or line is formed in a recorded letter or image, and the like, thereby lowering the printing quality. To address this problem, there has been proposed an ink-jet head provided with an auxiliary head which jets the ink in place of a nozzle at which the jetting failure occurred, thereby degrading the printing quality.

For example, an ink-jet printer described in Japanese Patent Application Laid-open No. 2005-88417 is provided with a line-type ink-jet head and an auxiliary head (head for substituting recording or complementary recording) which is movable relative to the ink-jet head in a longitudinal direction of the ink-jet head (direction in which the nozzles are arranged). The auxiliary head has a plurality of nozzles arranged in one array in a direction in which the recording paper is fed (paper feeding direction). The ink-jet printer is constructed such that, when jetting failure occurs in any of the nozzles in the line-type ink-jet head, the auxiliary head is moved such that a nozzle among the nozzles in the auxiliary head is located at a position, which is same as that of the nozzle, at which the jetting failure occurs (failed nozzle), of the ink-jet head, with respect to the direction in which the nozzles of the ink-jet head and the nozzles of the auxiliary head are respectively arranged; and that the ink is jetted from the nozzle in the auxiliary head, thereby complementing (substituting for, compensating for) the failed nozzle in the ink-jet head.

As another example, an ink-jet printer described in Japanese Patent Application Laid-open No. 11-334047 is provided with a line-type ink-jet head as a primary head; and an auxiliary head which is also a line-type head, which is arranged side by side with the primary head in the feeding direction for recording paper and which has a construction identical to that of the primary head. The ink-jet printer is constructed such that, when jetting failure occurs in any of the nozzles in the primary head, the ink is jetted from a nozzle among the nozzles in the auxiliary head located at a position, which is same as that of the failed nozzle in the primary head, with respect to the direction in which the nozzles of the ink-jet head and the nozzles of the auxiliary head are arranged.

It should be noted, however, that the number of nozzles at which the jetting failure occurs is not always limited to one. For example, the jetting failure often occurs concurrently at not less than two nozzles when the ink, adhered to a liquid-droplet jetting surface of the ink-jet head, is sucked into not less than two nozzles adjacent to each other on the liquid-droplet jetting surface, resulting in air entering into these nozzles. In the auxiliary head described in Japanese Patent Application Laid-open No. 2005-88417, however, the nozzles in the auxiliary head are arranged in parallel in one array in the paper feeding direction. Therefore, this auxiliary head can complement only one nozzle in the ink-jet head at one jetting-execution position. Therefore, when the jetting failure occurs concurrently at a plurality of nozzles, it is necessary that the auxiliary head is moved frequently at positions each corresponding to one of the failed nozzles.

On the other hand, the auxiliary head described in Japanese Patent Application Laid-open No. 11-334047 is a line-type head. Accordingly, even when the jetting failure occurs concurrently at a plurality of nozzles in the primary head, the auxiliary head can complement these failed nozzles at one time. In this case, however, one ink-jet printer is required to have as many as two line-type heads each having a large number of nozzles, thereby substantially increasing the manufacturing cost of the printer as a whole.

SUMMARY OF THE INVENTION

An object of the present invention is to provide a liquid-droplet jetting apparatus which is capable of efficiently complementing or substituting for a plurality of nozzles, of a line-type head, which have jetting failure, by using an auxiliary head having nozzles of which number is smaller than that in the line-type head.

According to a first aspect of the present invention, there is provided a liquid-droplet jetting apparatus for jetting liquid droplet, including: a first liquid-droplet jetting head provided with a first nozzle row including a plurality of first nozzles arranged in a predetermined first direction; a second liquid-droplet jetting head provided with a second nozzle row which includes a plurality of second nozzles arranged in the first direction, and which is shorter than the first nozzle row; a driving mechanism which drives the second liquid-droplet head in the first direction; and a position detector which detects a position of the second liquid-droplet head with respect to the first direction; wherein a first pitch at which the first nozzles of the first nozzle row are arranged and a second pitch at which the second nozzles of the second nozzle row are arranged are same.

According to this construction, when jetting failure such as non-jetting or bending of the jetting direction occurs at any of the first nozzles in the first liquid-droplet jetting head, the second liquid-droplet jetting head is moved to a position, corresponding to the first nozzle at which the jetting failure occurred (failed first nozzle), so as to jet the liquid from a second nozzle among the second nozzles of the second liquid-droplet jetting apparatus in place of the failed first nozzle, thereby complementing or substituting for the failed first nozzle in the first liquid-droplet jetting head. Here, since the first pitch at which the first nozzles of the first nozzle row are arranged and the second pitch at which the second nozzles of the second nozzle row are arranged are same, even when the jetting failure occurs concurrently at two or more of the first nozzles adjacent to each other, the plurality of second nozzles can complement the failed first nozzles at one time. In other words, it is possible to effectively complement the failed first nozzles in the first liquid-droplet jetting head, with the second liquid-droplet jetting head in which the length of the nozzle row is shorter (the number of the nozzles is smaller) than that of the first liquid-droplet jetting head, and thus which can be produced at a low cost.

In the liquid-droplet jetting apparatus of the present invention, the first nozzle row of the first liquid-droplet jetting head may include a plurality of first nozzle arrays (rows) aligned in a second direction orthogonal to the first direction; the second nozzle row of the second liquid-droplet jetting head may include a plurality of second nozzle arrays (rows) aligned in the second direction; and a first shift amount by which two adjacent first nozzle arrays, among the first nozzle arrays, are shifted from each other in the first direction, and a second shift amount by which two adjacent second nozzle arrays, among the second nozzle arrays, are shifted from each other in the first direction may be same. According to this construction, even when the jetting failure occurs concurrently at two first nozzles, each belonging to one of the two first nozzle arrays (rows) adjacent to each other in the first liquid-droplet jetting head, it is possible to complement these failed two first nozzles in the first liquid-droplet jetting head at one time with two second nozzles each belonging to one of the two second nozzle arrays (rows) adjacent to each other in the second liquid-droplet jetting head.

In the liquid-droplet jetting apparatus, the two adjacent first nozzle arrays may be arranged closely to each other with respect to the second direction. When the two adjacent first nozzle arrays are arranged to closely to each other in such a manner, an ink, which adheres to a portion around a certain first nozzle belonging to one of the two adjacent first nozzle arrays, also adheres to a portion around another first nozzle belonging to the other of the two adjacent first nozzle arrays, thereby causing the jetting failure concurrently at these two first nozzles in some cases. In such a situation, however, the ink-jet head of the present invention is capable of complementing these failed first nozzles in the two adjacent first nozzle arrays of the first liquid-droplet jetting head, with two second nozzles each belonging to one of the two adjacent second nozzle arrays of the second liquid-droplet jetting head.

In the liquid-droplet jetting apparatus, two first nozzles, each of which belongs to one of the two adjacent first nozzle arrays and which are arranged to shift from each other by the first shift amount in the first direction, may be communicated with a common liquid chamber at two communication ports, respectively, which are arranged closely to each other. In such a construction in which the two first nozzles, each belonging to one of the two adjacent first nozzle arrays, are communicated with a common liquid chamber; in which the two communicating ports for the two first nozzles, respectively, are arranged closely to each other; and when a large air bubble enters into the common liquid chamber and further enters into the two first nozzles concurrently, then the jetting failure occurs concurrently at these two first nozzles in some cases. In such a situation, however, the ink-jet head of the present invention is capable of complementing, at one time, these failed first nozzles each belonging to one of the two adjacent first nozzle arrays of the first liquid-droplet jetting head, by using two second nozzles each belonging to one of the two adjacent second nozzle arrays of the second liquid-droplet jetting head.

The liquid-droplet jetting apparatus of the present invention may further include: a memory which stores an information for identifying a first nozzle which is included in the first nozzles belonging to the first nozzle row and at which jetting failure occurs; and a jetting-position determining section which determines, based on the information stored in the memory, a jetting-executing position for the second liquid-droplet jetting head and a second nozzle which is included in the second nozzles and which is to jet a liquid droplet in place of the first nozzle at which the jetting failure occurs. According to this construction, when the jetting failure occurs at any of the first nozzles in the first liquid-droplet jetting head, it is possible to efficiently perform the substitute jetting (complementary jetting) by a second nozzle, among the second nozzles, in the second liquid-droplet head for the failed first nozzle in the first liquid-droplet jetting head.

In the liquid-droplet jetting apparatus of the present invention, the jetting-position determining section may determine the jetting-execution position and the second nozzle to reduce a number of times that the second liquid-droplet jetting head moves in the first direction. According to this construction, even when the jetting failure occurs concurrently at first nozzles among the plurality of first nozzles, the number of times for moving the second liquid-droplet jetting head in the first direction is small (reduced), thereby making it possible to quickly perform the substitute jetting by the second liquid-droplet jetting head.

The liquid-droplet jetting apparatus of the present invention may further include a failed-nozzle detector which detects a first nozzle which is included in the first nozzles belonging to the first nozzle row and at which the jetting failure occurs. According to this construction, it is possible to identify the first nozzle at which the jetting failure occurs, thereby making it possible to quickly perform the substitute jetting by the second nozzle in the second liquid-droplet jetting head.

In liquid-droplet jetting apparatus of the present invention, the first nozzle row of the first liquid-droplet jetting head may include a plurality of first nozzle arrays (rows) which jet a plurality of liquids, respectively; and the second nozzle row of the second liquid-droplet jetting head may include a plurality of second nozzle arrays (rows) which jet the plurality of liquids, respectively. According to this construction, even when jetting failure occurs concurrently at first nozzles each belonging to one of the plurality of first nozzle arrays which jet the plurality of liquids respectively, it is possible to complement the failed first nozzles with the second liquid-droplet jetting head. Further, since the second liquid-droplet head is provided with the plurality of second nozzle arrays (rows) which jet the plurality of liquids respectively, the construction (the driving mechanism, the position detector, and the like) for moving the second liquid-droplet jetting head in the first direction becomes simpler as compared to a case in which the substitute jetting is performed separately with a plurality of heads each of which has the plurality of second nozzle arrays.

The liquid-droplet jetting apparatus of the present invention may further include a movable body which is movable in the first direction and which is provided with a detector which detects a jetting state of the first nozzles. The movable body may further include a purge cap which covers jetting ports of the first nozzles. According to this construction, the detector and the purge cap provided on the movable body moves integrally with the movable body. Accordingly, when jetting abnormality or failure is detected at the detector, it is possible to immediately purge a nozzle, among the nozzles, which is detected as having jetting abnormality, thereby making it possible to recover the nozzle from the abnormality.

DETAILED DESCRIPTION OF THE PREFERRED EMBODIMENTS

First Embodiment

The first embodiment of the present invention will be explained as follows. This embodiment is an example in which the present invention is applied to an line-type ink-jet printer, as a liquid-droplet jetting apparatus, which jets an ink onto a recording paper.

Figure 1:
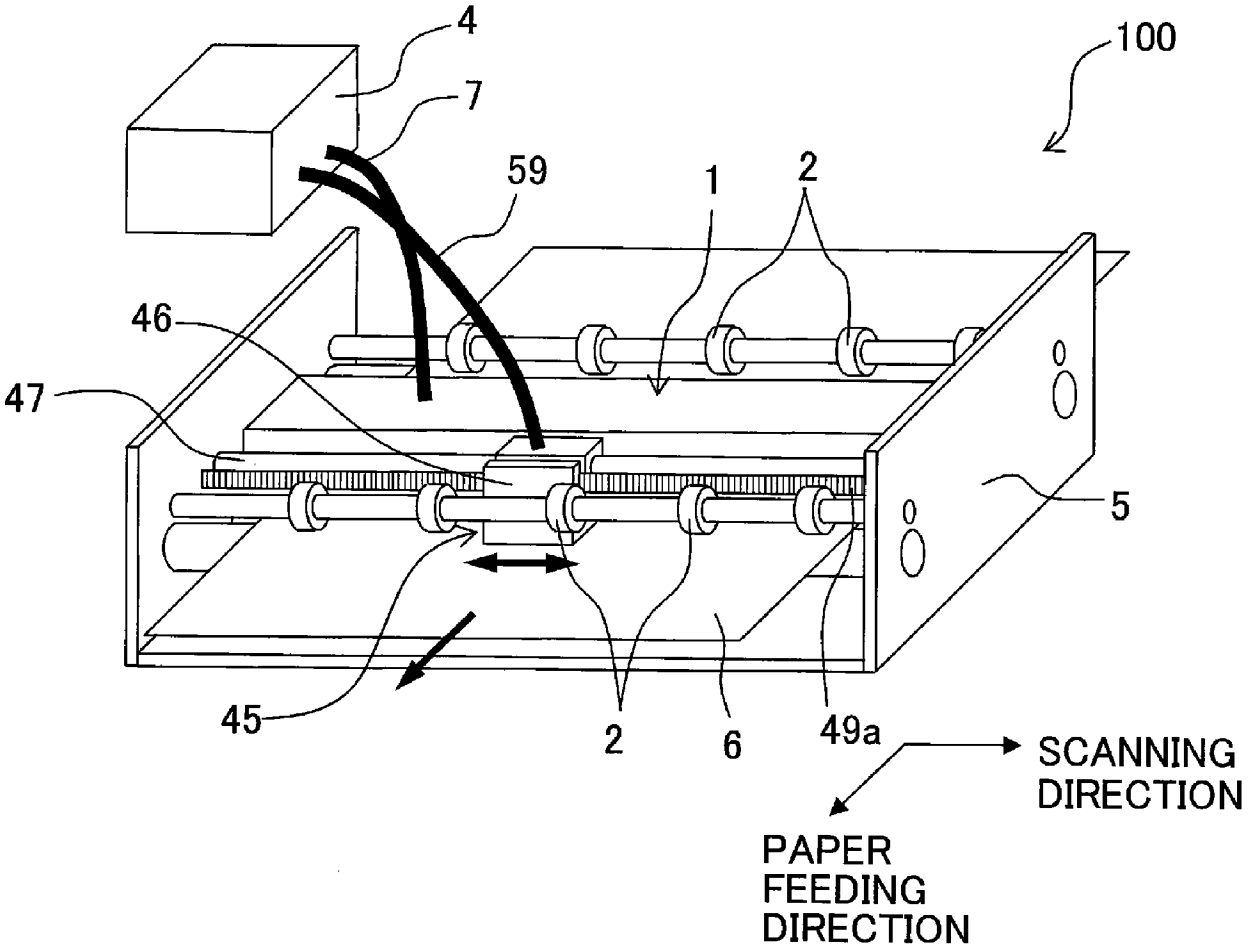
FIG. 1 is a schematic view showing a construction of an ink-jet printer according to a first embodiment of the present invention.

First, the schematic structure of an ink-jet printer 100 of the first embodiment will be explained. As shown in FIG. 1, the ink-jet printer 100 has an ink-jet head 1 (first liquid-droplet jetting head) which is an line-type head supported at both end thereof in a printer body 5 and which extends in a width direction of recording paper 6 (scanning direction; left and right direction in FIG. 1); feeding rollers 2 which feed or transport the recording paper 6 in a forward direction in FIG. 1; a control unit 3 (see FIG. 10) which controls the entire ink-jet printer 10; and the like. The ink-jet head 1 jets an ink, supplied from an ink tank 4 via a tube 7, through a plurality of nozzles 20 (first nozzles, see FIGS. 2 to 5) which are arranged in arrays (rows) in the scanning direction, onto the recording paper 6 so as to record a desired letter and/or image on the recording paper 6. The recording paper 6, on which the letter and/or image has been recorded by the ink-jet head 1, is discharged in the forward direction (paper feeding direction) by the feeding roller 2 driven and rotated by a feed motor 8 (see FIG. 10).

Also, as shown in FIG. 1, an auxiliary head 45 (second liquid-droplet jetting head) which is movable in the scanning direction, is provided at a position in front of the ink-jet head 1. This auxiliary head 45 is employed to jet the ink, when a jetting failure occurs at any of the nozzles 20 in the ink-jet head 1, in place of the failed nozzle 20 in the ink-jet head 1. The auxiliary head 45 will be explained in detail later on.

Next, the line-type ink-jet head 1 will be explained. As shown in FIGS. 2 to 5, the ink-jet head 1 is provided with a channel unit 400 in which an ink channel including the nozzles 20 and pressure chambers 14 is formed; and a piezoelectric actuator 300 which is arranged on an upper surface of the channel unit 400 and which applies a jetting pressure to the ink in the pressure chambers 14.

Figure 4:
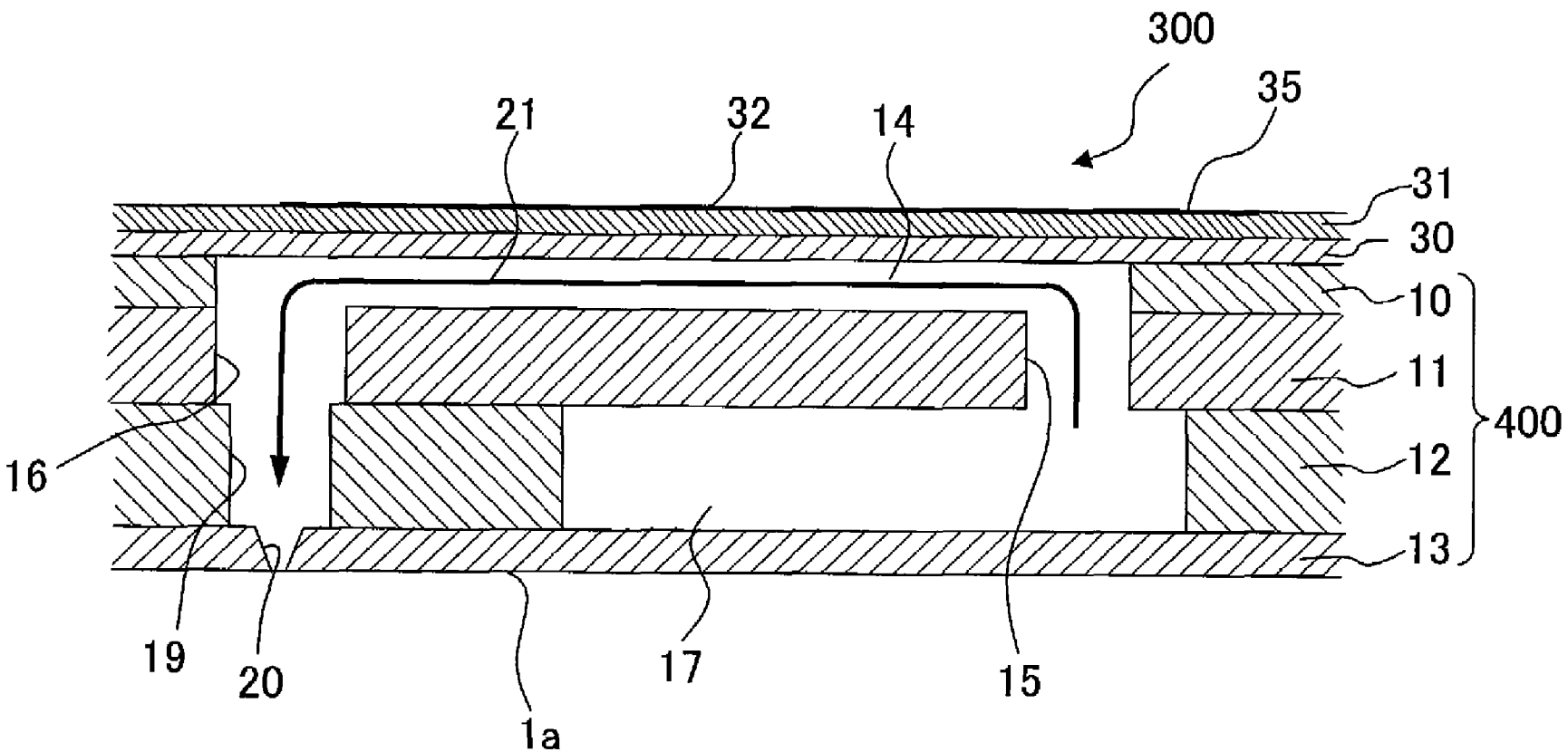
FIG. 4 is a sectional view taken along a line IV-IV in FIG. 3.
Figure 5:
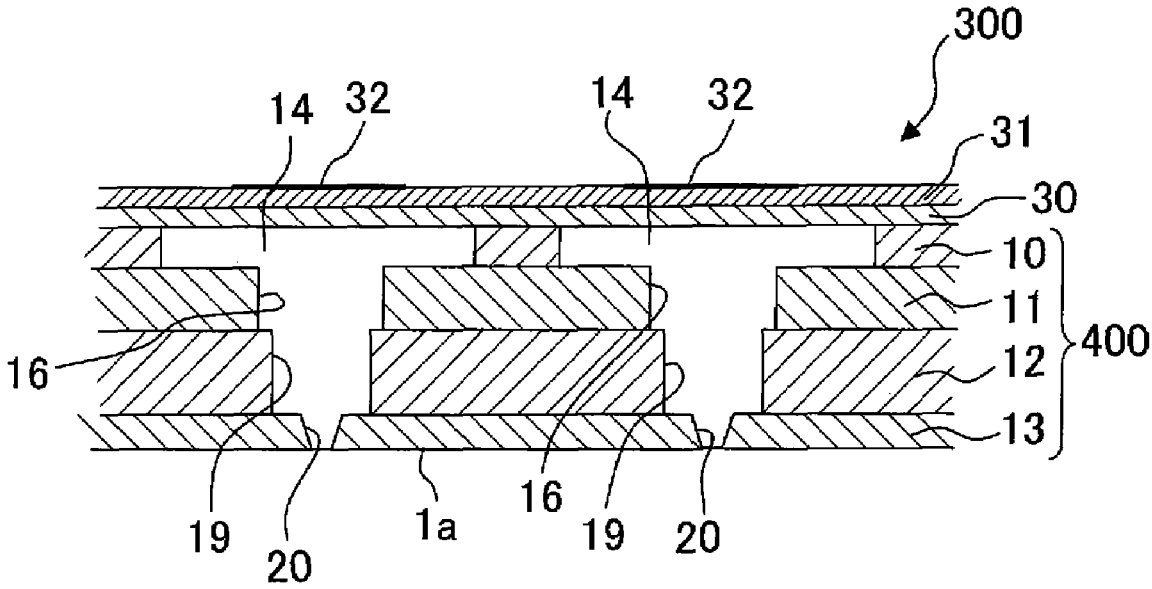
FIG. 5 is a sectional view taken along a line V-V in FIG. 3.

First, the channel unit 400 will be explained. As shown in FIGS. 4 and 5, the channel unit 400 is provided with a cavity plate 10, a base plate 11, a manifold plate 12, and a nozzle plate 13, and these four plates 10 to 13 are joined together in stacked layers. Among these plates, the cavity plate 10, the base plate 11 and the manifold plate 12 are plates made of stainless steel. The ink channel such as the pressure chambers 14, a manifold 17 which will be explained later, and the like are easily formed in these plates 10 to 12 by etching. Further, the nozzle plate 13 is formed, for example, of a high-molecular synthetic material such as polyimide, and is adhered on a lower surface of the manifold plate 12. Alternatively, this nozzle plate 13 may be also formed of a metallic material such as stainless steel similarly to the three plates 10 to 12.

As shown in FIGS. 2 to 5, among the four plates 10 to 13, the cavity plate 10 located at the uppermost position in the stacked plates has a plurality of pressure chambers 14 which are formed in the cavity plate 10 in a shape of through holes penetrating through the cavity plate 10, and which are arranged in arrays on a plane. Each of the pressure chambers 14 is covered by a vibration plate 30 and by the base plate 11 from above and below, respectively. The vibration plate 30 will be explained later. Also, the pressure chambers 14 are arranged in four rows or arrays in the scanning direction (left and right direction in FIG. 2). Each of the pressure chambers 14 is formed in an elliptic shape which is long in the paper feeding direction (up and down direction in FIG. 2) in a plan view.

Communication holes 15 and 16 are formed in the base plate 11 at positions overlapping in a plan view with both ends, respectively, of one of the pressure chambers 14. Further, four manifolds 17 extending in the scanning direction (left and right direction in FIG. 2) are formed in the manifold plate 12. Each of the four manifolds 17 corresponds to one of the four arrays, of pressure chambers 14, extending in the scanning direction, and each of the manifolds 17 is overlapped in a plan view with the pressure chambers 14 belonging to one of the pressure chamber arrays, at upstream portions of the pressure chambers 14 located in upstream in the paper feeding direction (upper half portions of the pressure chambers 14 in FIG. 2). Furthermore, the four manifolds 17 communicate with an ink supply hole 18 formed in the vibration plate 30 which will be explained later, and the ink is supplied to the manifolds 17 from the ink tank 4 (see FIG. 1) via the ink supply hole 18. Moreover, a plurality of communication holes 19, communicating to the communication holes 16 respectively, are also formed in the manifold plate 12 at positions each overlapping in a plan view with an end of one of the pressure chambers 14 (lower end of the pressure chamber 14 in FIGS. 2 and 3), on a side opposite to one of the manifolds 17.

Figure 2:
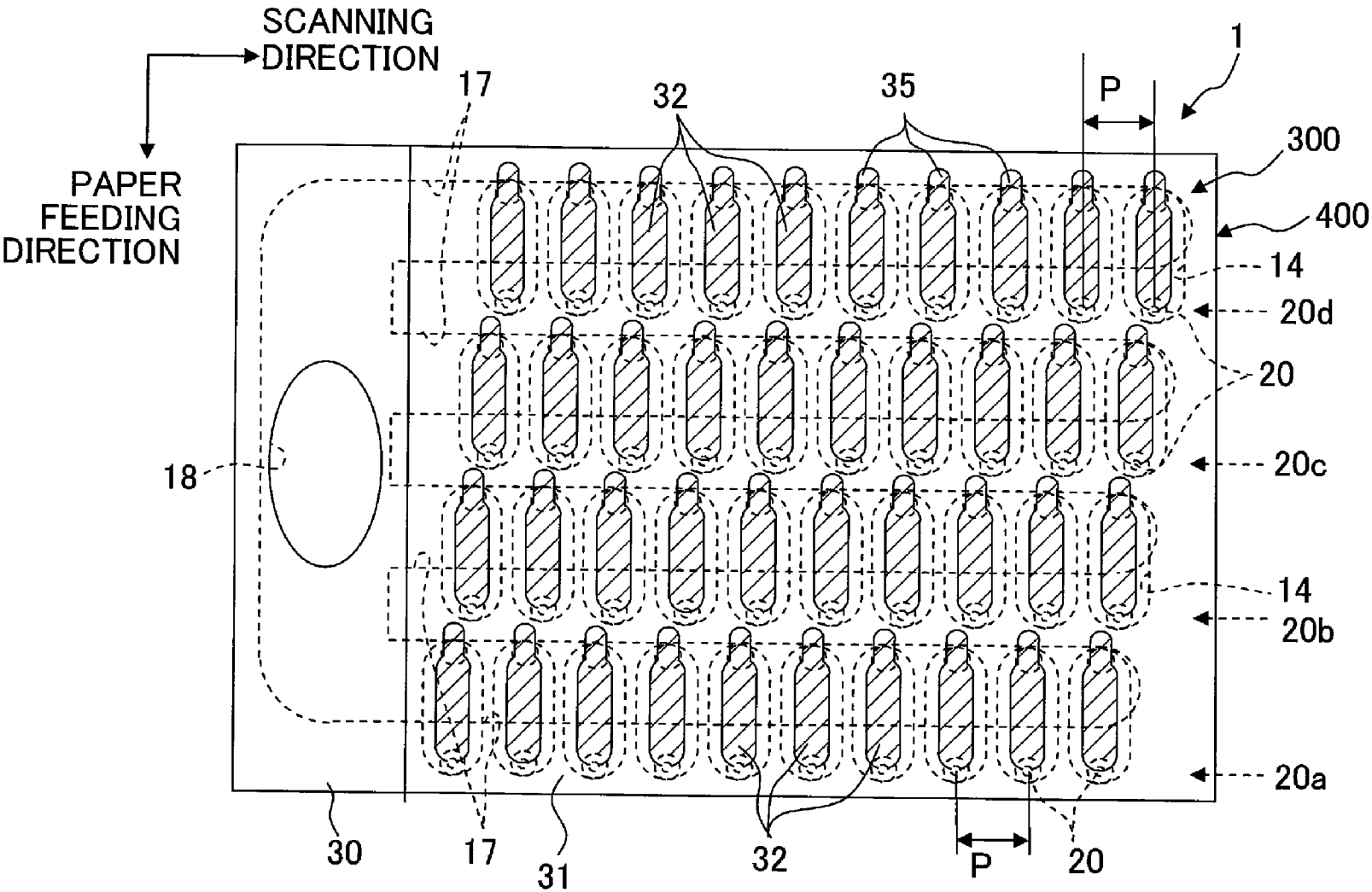
FIG. 2 is a plan view of a line-type ink-jet head.
Figure 3:
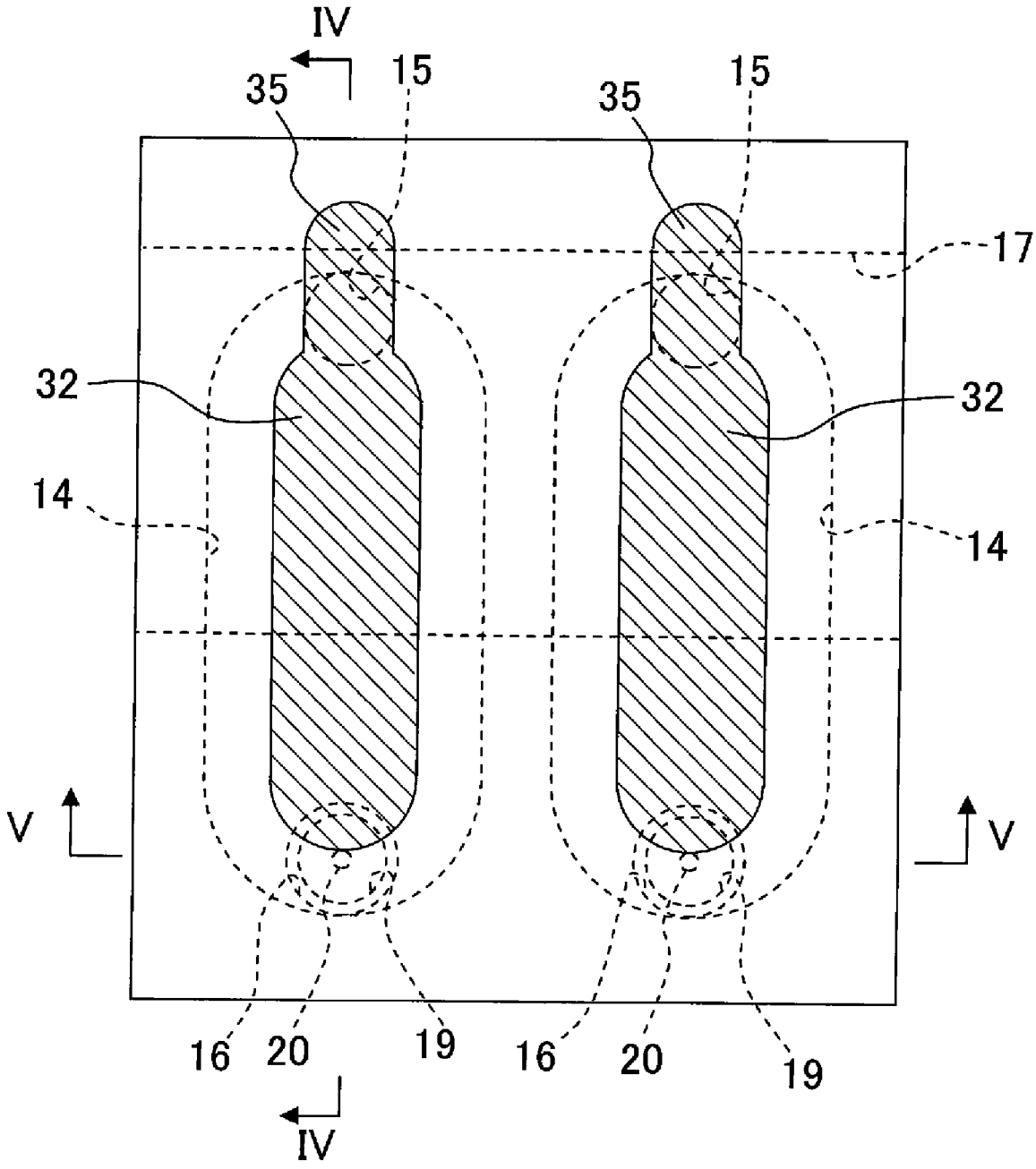
FIG. 3 is a partially enlarged view of FIG. 2.

Further, a plurality of nozzles 20 are formed in the nozzle plate 13 at positions each overlapping in a plan view with one of the communication holes 19. As shown in FIG. 2, each of the nozzles 20 is overlapped with the one end, of one of the pressure chambers 14 arranged in the four arrays, on the side opposite to one of the manifolds 17, and the nozzles 20 are arranged in arrays or rows in the scanning direction (left and right direction in FIG. 2: first direction) in areas not overlapping with the four manifolds 17, respectively, such that the nozzles 20 form or construct four nozzle rows (arrays) 20*a* to 20*d* aligned in the paper feeding direction (up and down direction in FIG. 2: second direction) orthogonal to the scanning direction. With respect to the four nozzle rows 20*a* to 20*d*, a nozzle arrangement pitch P (hereinafter referred to simply as "pitch P") at which the nozzles 20 are arranged, is same in all of the nozzle rows 20*a* to 20*d*. Furthermore, a lower surface of the nozzle plate 13 is a liquid-droplet jetting surface 1*a* in which jetting ports of the nozzles 20*a* are formed. Moreover, as shown in FIGS. 4 and 5, each of the nozzles 20 is formed in a taper shape (tapered), and an axis line thereof is parallel to the vertical direction. Therefore, when the nozzles 20 are normal, liquid droplets are jetted from the nozzles 20 downwardly in the vertical direction.

Thus, as shown in FIG. 4, each of the manifolds 17 communicates with one of the pressure chambers 14 via one of the communication holes 15, and each of the pressure chambers 14 communicates with one of the nozzles 20 via the communication holes 16, 19. In this manner, in the channel unit 400, a plurality of individual ink channels 21, each from one of the manifolds 17 to one of the nozzles 20 via one of the pressure chambers 14, is formed.

Next, the piezoelectric actuator 300 will be explained. As shown in FIGS. 2 to 5, the piezoelectric actuator 300 has a vibration plate 30 arranged on the upper surface of the channel unit 400; a piezoelectric layer 31 formed continuously on the upper surface of the vibration plate 30 so as to cover the pressure chambers 14; and a plurality of individual electrodes 32 which are formed on the upper surface of the piezoelectric layer 31 to correspond to the pressure chambers 14, respectively.

The vibration plate 30 is substantially rectangular in a plan view, and is an electrically conductive plate formed of a metallic material such as an iron alloy like stainless steel, a copper alloy, a nickel alloy, a titanium alloy, or the like. The vibration plate 30 is arranged on the upper surface of the cavity plate 10 so as to cover the pressure chambers 14, and is adhered to the cavity plate 10. Further, the vibration plate 30 is always kept at ground potential, and functions also as a common electrode which makes an electric field act in the piezoelectric layer 31 between the individual electrodes 32 and the vibration plate 30, in a thickness direction of the piezoelectric layer 31.

On the upper surface of the vibration plate 30, the piezoelectric layer 31, mainly composed of a lead zirconate titanate (PZT) which is a ferroelectric solid solution of lead zirconate and lead titanate. The piezoelectric layer 31 is formed continuously so as to cover the pressure chambers 14. The piezoelectric layer 31 can be formed, for example, by an aerosol deposition method (AD method) in which ultra-fine particulate material is collided onto an objective surface so as to make the particulate material to deposit on the objective surface. Other than the AD method, the piezoelectric layer 31 can be also formed by using a method such as a sol-gel method, a sputtering method, a hydrothermal synthesis method, a CVD (chemical vapor deposition) method, or the like. Still alternatively, the piezoelectric layer 31 can be formed by cutting a piezoelectric sheet, obtained by calcinating a green sheet of PZT, and then by bonding the piezoelectric sheet to the vibration plate 30.

On the upper surface of the piezoelectric layer 31, the individual electrodes 32 are formed to correspond to the pressure chambers 14, respectively. Each of the individual electrodes 32 is substantially ecliptic in a plan view, is smaller to some extent than one of the pressure chambers 14 in a plan view, and is formed at a position overlapping in a plan view with a central portion of one of the pressure chambers 14 to which the individual electrode 32 corresponds. Further, the individual electrodes 32 are formed of an electrically conductive material such as gold, copper, silver, palladium, platinum, titanium, or the like. Furthermore, a plurality of contact points 35 are drawn each from one end of one of the individual electrodes 32 (one end of one of the individual electrodes 32 on the side of the manifold 17). These contact points 35 are connected to contact points, respectively, of a flexible wiring member (not shown) such as a flexible printed circuit (FPC) or the like. The individual electrodes 32 are electrically connected via this wiring member to a driver IC 22 (see FIG. 10) which applies a drive voltage selectively to the individual electrodes 32. The individual electrodes 32 and the contact points 35 can be formed by a method such as screen printing, the sputtering method, a vapor deposition method, or the like.

Next, the operation of the piezoelectric actuator 300 upon jetting the ink will be explained. When a drive voltage is applied from the driver IC 22 selectively to the plurality of individual electrodes 32, a potential difference is generated between a certain individual electrode 32 among the individual electrodes 32, which is disposed on the piezoelectric layer 31 and to which the drive voltage is applied, and the vibration plate 30 as the common electrode which is disposed under the piezoelectric layer 31 and maintained at ground potential, thereby generating an electric field in a thickness direction of the piezoelectric layer 31 in a portion of the piezoelectric layer 31 sandwiched between the individual electrode 32 and the vibration plate 30. At this time, when a direction in which the piezoelectric layer 31 is polarized and the direction of the electric field are same, the portion of the piezoelectric layer 31, which is positioned directly below the individual electrode 32 applied with the drive voltage, expands in the thickness direction in which the piezoelectric layer 31 is polarized and contracts in a horizontal direction (direction parallel to the plane of the piezoelectric layer 31 and orthogonal to the polarization direction). Then, accompanying with the contracting deformation of the piezoelectric layer 31, the vibration plate 30 is deformed to project toward a pressure chamber 14, among the pressure chambers 14, corresponding to the individual electrode 32. Accordingly, the volume of the pressure chamber 14 is decreased to apply pressure to the ink in the pressure chamber 14, thereby jetting an ink droplet of the ink from a nozzle 20 communicating with the pressure chamber 14.

In this case, as described above, the line-type ink-jet head 1 has a large number of nozzles 20 in a direction orthogonal to the paper feeding direction. Therefore, when dust and/or air enter and mix in any of the nozzles 20, the jetting failure is easily occur such that the liquid droplet of the ink cannot be jetted (non-jetting of the ink) from the nozzle 20 into which the dust and/or air entered; a liquid droplet of the ink is jetted from the nozzle 20 in a direction bent or deviated from an intended jetting direction (bending of the jetting direction) and thus the liquid droplet lands on a position deviated from an intended landing position; or the like. When the recording is performed in a state that such a jetting failure occurs at any of the nozzles 20, a while streak or line is formed in a recorded letter, image, and the like, thereby lowering the printing quality.

Figure 6:
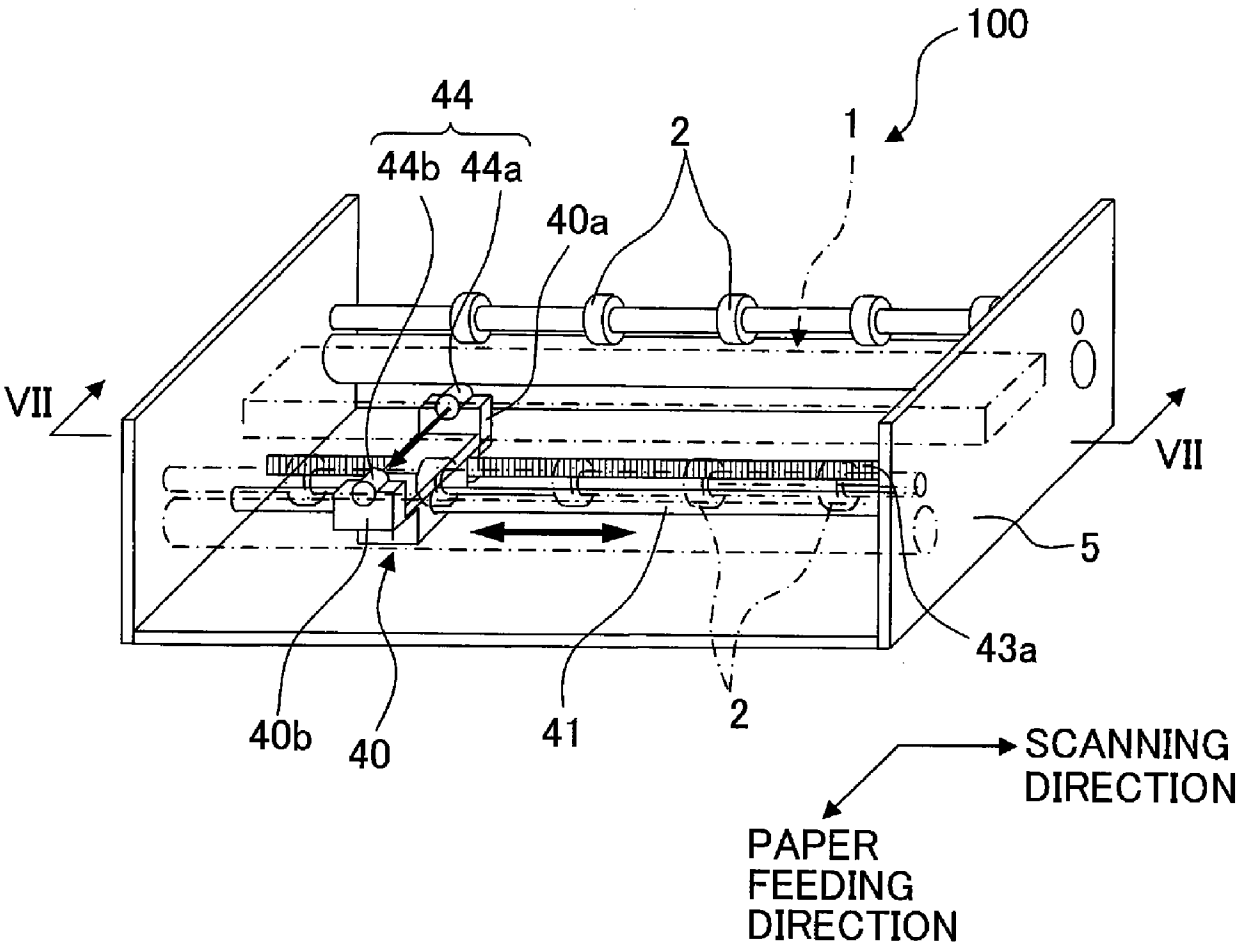
FIG. 6 is a perspective view showing a construction for performing detection operation of a jetting state of the nozzles.

In view of such a problem, as shown in FIGS. 1 and 6, the ink-jet printer 100 of the first embodiment is provided with a jetting-state detector 44 (failed-nozzle detector) which detects a jetting state for all of the nozzles 20 to identify a nozzle 20, among the nozzles 20, at which the jetting failure occurs (failed nozzle 20); and the auxiliary head 45 (second ink-jet head) which jets the ink in place of the nozzle 20 at which the jetting failure is detected by the jetting-state detector 44.

Figure 7:
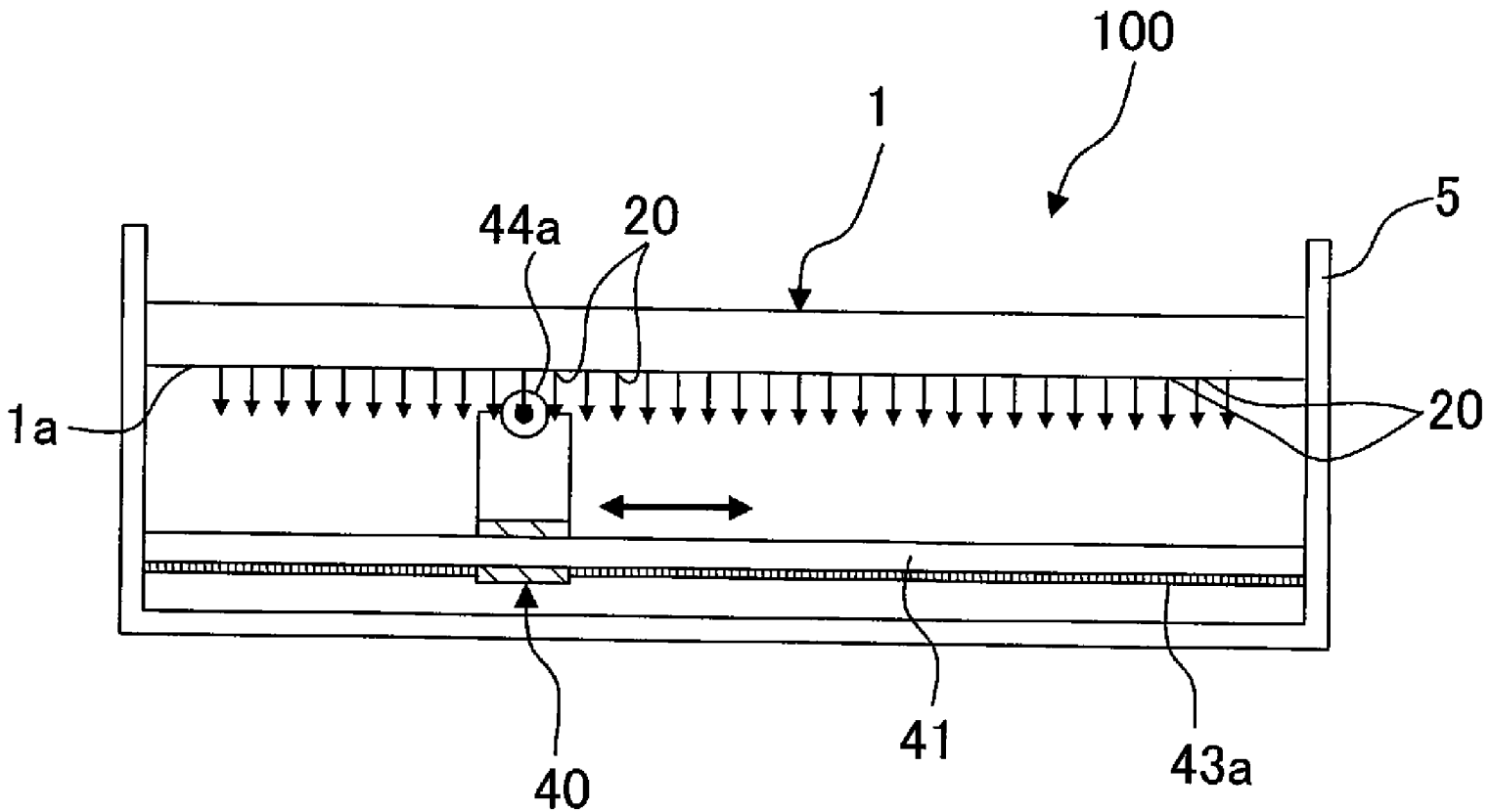
FIG. 7 is a sectional view taken along a line VII-VII in FIG. 6.

As shown in FIGS. 6 and 7, a movable body 40 facing an liquid-droplet jetting surface 1*a* of the ink-jet head 1 is arranged at a position immediately below the ink-jet head 1 to be movable along a guide shaft 41, with respect to the ink-jet head 1, in the scanning direction (the direction in which the nozzles 20 are arranged). The movable body 40 is driven in the scanning direction by a movable-body drive motor 42 (see FIG. 10). Further, the ink-jet head 1 also includes a scale 43*a*, and a linear encoder 43 (position detector: see FIG. 10) which detects a position of the movable body 40 in the scanning direction is provided. The scale 43*a* is arranged parallel to the scanning direction.

As shown in FIG. 6, the jetting-state detector 44, which detects the jetting state of liquid droplet of each of the nozzles 20, is provided on the upper portion of the movable body 40. The jetting-state detection section 44 has a light emitting element 44*a* which is arranged on a wall 40*a* located at the far end (upstream in the paper feeding direction in FIG. 6) of the movable body 40, and which emits laser beam in a forward direction (direction orthogonal to the direction in which the nozzles are arranged); and a light receiving element 44*b* which is arranged on a wall 40*b* located at the front end (downstream in the paper feeding direction in FIG. 6) of the movable body 40, and which receives the laser beam emitted from the light emitting element 44*a*. The jetting-state detector 44 is movable integrally with the movable body 40 in the scanning direction.

When printing is performed by jetting the ink onto the recording paper 6 from the nozzles 20 of the ink-jet head 1, the movable body 40 is located (standing by) at a stand-by position at one side (right side in FIG. 6) in the scanning direction with respect to a feeding passage for the recording paper 6. On the other hand, when a command for detecting the jetting state is inputted to the control unit 3 (see FIG. 10) of the ink-jet printer 100, the movable body 40 is moved leftward from the stand-by position so as to cross over (traverse across) the feeding passage.

Then, as shown in FIG. 7, when a liquid droplet is jetted from a certain nozzle 20, of the nozzles 20, normally (downwardly in the vertical direction) in a state that the movable body 40 is located at a position immediately below the certain nozzle 20 (at a position extended from the axis line of the certain nozzle 20), laser beam emitted from the light emitting element 44*a* in the forward direction is momentarily blocked by the liquid droplet jetted downwardly in the vertical direction, thereby interrupting the light reception by the light receiving element 44*b*. Thus, the jetting state of the certain nozzle 20 is detected to be normal. On the other hand, when a liquid droplet is not jetted from this nozzle 20 normally or when the liquid droplet is jetted in a direction deviated or bent in the scanning direction, the laser beam emitted in the forward direction from the light emitting element 44*a* is not blocked by the liquid droplet and thus the light reception by the light receiving element 44*b* is not interrupted (disturbed). Thus, the jetting state of this nozzle is detected to be abnormal. Then, it is possible to identify a nozzle 20 in which the jetting state is abnormal, by performing a series of these operations for all of the nozzles 20 while moving the movable body 40.

Figure 10:
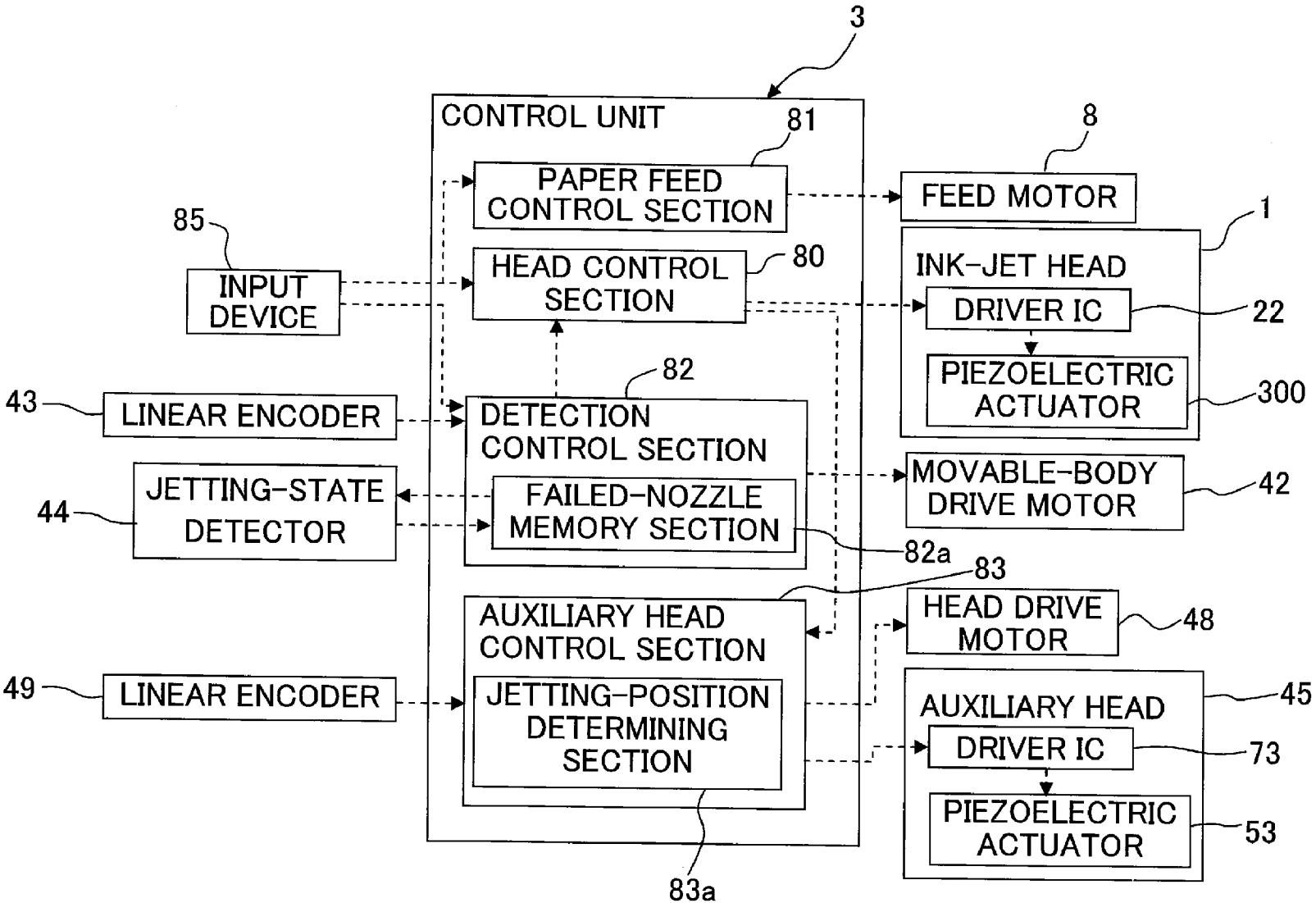
FIG. 10 is a block diagram showing an electrical construction of the ink-jet printer.

As shown in FIG. 1, the auxiliary head 45 is provided on the carriage 46 movable along the guide shaft 47 in the scanning direction, and the carriage 46 and the auxiliary head 45 are integrally driven in the scanning direction by a head drive motor 48 (driving mechanism, see FIG. 10). Further, the ink-jet head 100 also includes a scale 49*a*, and the linear encoder 49 (position detector: see FIG. 10) which detects a position of the auxiliary head 45 in the scanning direction is provided. The scale 49*a* is arranged parallel to the scanning direction.

Figure 8:
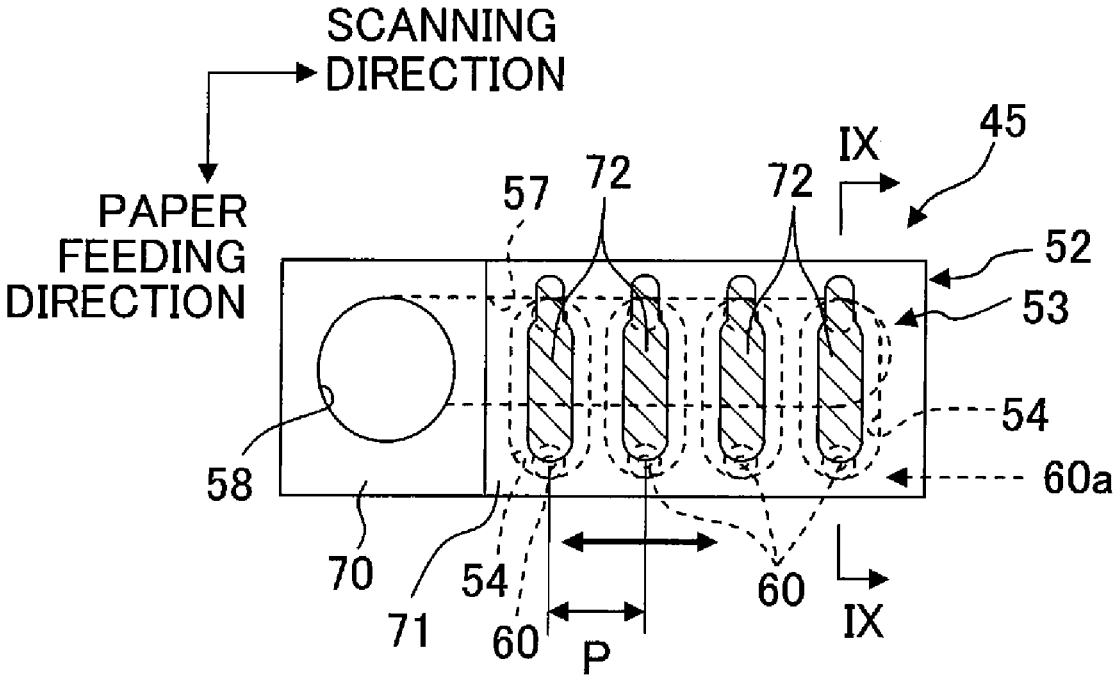
FIG. 8 is a plan view of an auxiliary head.
Figure 9:
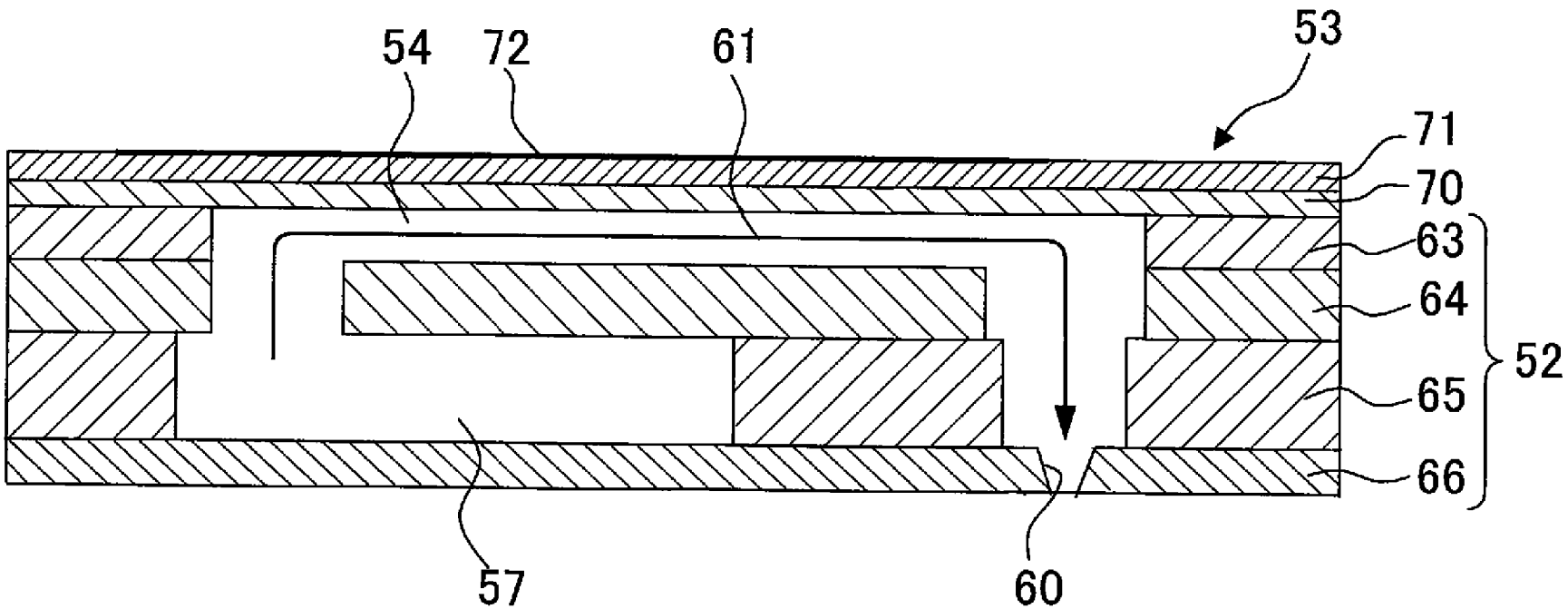
FIG. 9 is a sectional view taken along a line IX-IX in FIG. 8.

The auxiliary head 45 has a construction which is basically same as that of the line-type ink-jet head 1 as described above, except for the numbers of the pressure chambers and of the nozzles. Namely, as shown in FIGS. 8 and 9, the auxiliary head 45 is constructed of four metallic plates 63 to 66 stacked in layers, and has a channel unit 52 having an ink channel which is formed in the channel unit 52 and which includes pressure chambers 54 and nozzles 60; and a piezoelectric actuator 53 arranged on the upper surface of the channel unit 52.

In the channel unit 52, four pressure chambers 52, a nozzle row 60*a* (second nozzle row) constructed of four nozzles 60 (second nozzles), and a manifold 57 are formed. The four pressure chambers 54 have a substantially elliptic form in a plan view and are arranged in one array in the scanning direction. The four nozzles 60 communicate with the four pressure chambers 54, respectively, and are also arranged in an array in the scanning direction. The manifold 57 extends in the scanning direction and communicates with the pressure chambers 54. The pressure chambers 54 and the nozzles 60 are formed to have same shape and size as those of the pressure chambers 14 and the nozzles 20 (see FIGS. 2 and 3), respectively, of the ink-jet head 1. Further, a pitch at which the nozzles 60 in the nozzle row 60*a* are arranged is same as the pitch P (see FIG. 2) at which the nozzles 20 in each of the four nozzle rows 20*a* to 20*d* in the ink-jet head 1 are arranged; and a length of the nozzle row 60*a* is smaller than the length of each of the nozzle rows 20*a* to 20*d* in the ink-jet head 1 (namely, the nozzle row 60*a* has the nozzles in smaller number than in the each of the nozzles arrays 20*a* to 20*d*). As shown in FIGS. 1 and 8, the manifold 57 is connected to the ink tank 4 via a tube 59 and an ink supply hole 58 which is formed in a vibration plate 70, of the piezoelectric actuator 53, covering the four pressure chambers 54. Furthermore, as shown in FIG. 9, individual ink channels 61, each of which from the manifold 57 to one of the nozzles 60 via one of the pressure chambers 54, are formed in the channel unit 52 in substantially same shape and a substantially same size as those of the individual ink channels 21 (see FIG. 4) in the ink-jet head 1.

The piezoelectric actuator 53 has an approximately same construction as that of the piezoelectric actuator 300 (see FIGS. 2 to 5) in the ink-jet head 1. Namely, as shown in FIGS. 8 and 9, the piezoelectric actuator 53 has the vibration plate 70 covering the four pressure chambers 54; a piezoelectric layer 71 formed on the upper surface of the vibration plate 70; and four individual electrodes 72 formed on the upper surface of the piezoelectric layer 71 to correspond to the four pressure chambers 54, respectively. Each of the individual electrodes 72 is formed to have same shape and size as those for each of the individual electrodes 32 in the ink-jet head 1, and is arranged to face the central portion of one of the pressure chambers 54 to which the individual electrode 32 corresponds. Further, the four individual electrodes 72 are connected to a driver IC 73 (see FIG. 10), and are constructed to be selectively applied with a drive voltage from the driver IC 73.

When the jetting-state detector 44 detects that jetting failure occurs at a certain nozzle 20 among the nozzles 20 in the ink-jet head 1, the auxiliary head 45 is moved to a position (jetting-execution position) such that any of the four nozzles 60 in the auxiliary head 45 is located at a position same in the scanning direction as that for the failed nozzle 20 in the ink-jet head 1, so as to jet the ink from the nozzle 60 instead of the failed nozzle 20 (substitute jetting). This operation of substitute jetting is controlled by the control unit 3 of the ink jet printer 100, which will be explained next.

An explanation will be given about an electrical construction of the ink-jet printer 100, mainly about the control unit 3, with reference to a block diagram in FIG. 10. The control unit 3 is constructed of a CPU which is a Central Processing Unit; a ROM (Read Only Memory) which stores a various kinds of programs, data, and the like for controlling entire operations of the ink-jet printer 100; and a RAM (Random Access Memory) which temporarily stores data and the like which are processed in the CPU; and the like.

Further, this control unit 3 is provided with a head control section 80 which controls the jetting operation of the ink-jet head 1; a paper feed control section 81 which controls the feeding operation for the recording paper 6 by the feed motor 8; a detection control section 82 which controls the detection operation for detecting the jetting state of the nozzles 20 by the movable body 40 and the jetting-state detector 44 when jetting failure occurs at any of the nozzles 20 in the ink-jet head 1; and an auxiliary head control section 83 which control the substitute jetting by the auxiliary head 45. Each of the head control section 80, paper feed control section 81, detection control section 82, and auxiliary head control section 83 is constructed of a CPU; a ROM; a RAM; a bass connecting the CPU, the ROM and the RAM; and the like.

When a print command and a printing data is inputted from an input device 85 such as a PC to the control unit 3, the head control section 80 outputs a command to the driver IC 22 in the ink-jet head 1 so as to apply a drive voltage selectively to the individual electrodes 32 (see FIGS. 2 to 5) in the piezoelectric actuator 300, thereby jetting the ink from the nozzles 20. At the same time, the paper feeding control section 81 controls the feed motor 8 to drive and rotate the feeding rollers 2 (see FIG. 1), thereby feeding the recording paper 6 in the paper feeding direction at a predetermined feeding velocity.

Further, for example, when the user visually confirms that printing failure such as a white streak (white line) occurs, a command for identifying a failed nozzle 20 among the nozzles 20 is inputted to the detection control section 82 from the input device 85 such as PC. Then, as shown in FIGS. 6 and 7, the detection control section 82 causes the jetting-state detection section 44 to emit laser beam from the light emitting element 44*a*; and controls, based on a positional information from the linear encoder 43, the movable-body drive motor 42 so as to move the movable body 40 leftward from the stand-by position to pass across (cross over) the feeding passage for the recording paper 6. Further, when the movable body 40 is moved to a position immediately below the nozzles 20, the detection control section 82 outputs a command to the head control section 80 so that a liquid droplet of the ink is jetted from a certain nozzle 20 among the nozzles 20. In this case, when the liquid droplet is jetted from the nozzle 20 normally (downward in the vertical direction), the laser beam from the light emitting element 44*a* is momentarily blocked by the liquid droplet. Therefore, it is detected that the jetting state of the nozzle 20 is normal. On the other hand, when the liquid droplet is not jetted from the nozzle 20, or the liquid droplet flies in a direction deviated (bent) in the direction in which the nozzles 20 are arranged (in a direction bent from left and right direction in FIG. 7), the laser beam from the light emitting element 44*a* is not blocked by the liquid droplet. Therefore, it is detected that the jetting state of the nozzle 20 is abnormal. Then, an information (for example, nozzle position, nozzle number and the like) for identifying the nozzle 20, at which the jetting failure occurs and which is detected by the jetting state detection section 44, is stored in a failed-nozzle memory section 82*a* (memory). Further, in order to prevent the ink from jetted from such a failed nozzle or nozzles 20 during a subsequent recording on the recording paper 6, the information for identifying failed nozzle is transmitted to the head control section 80.

Figure 11:
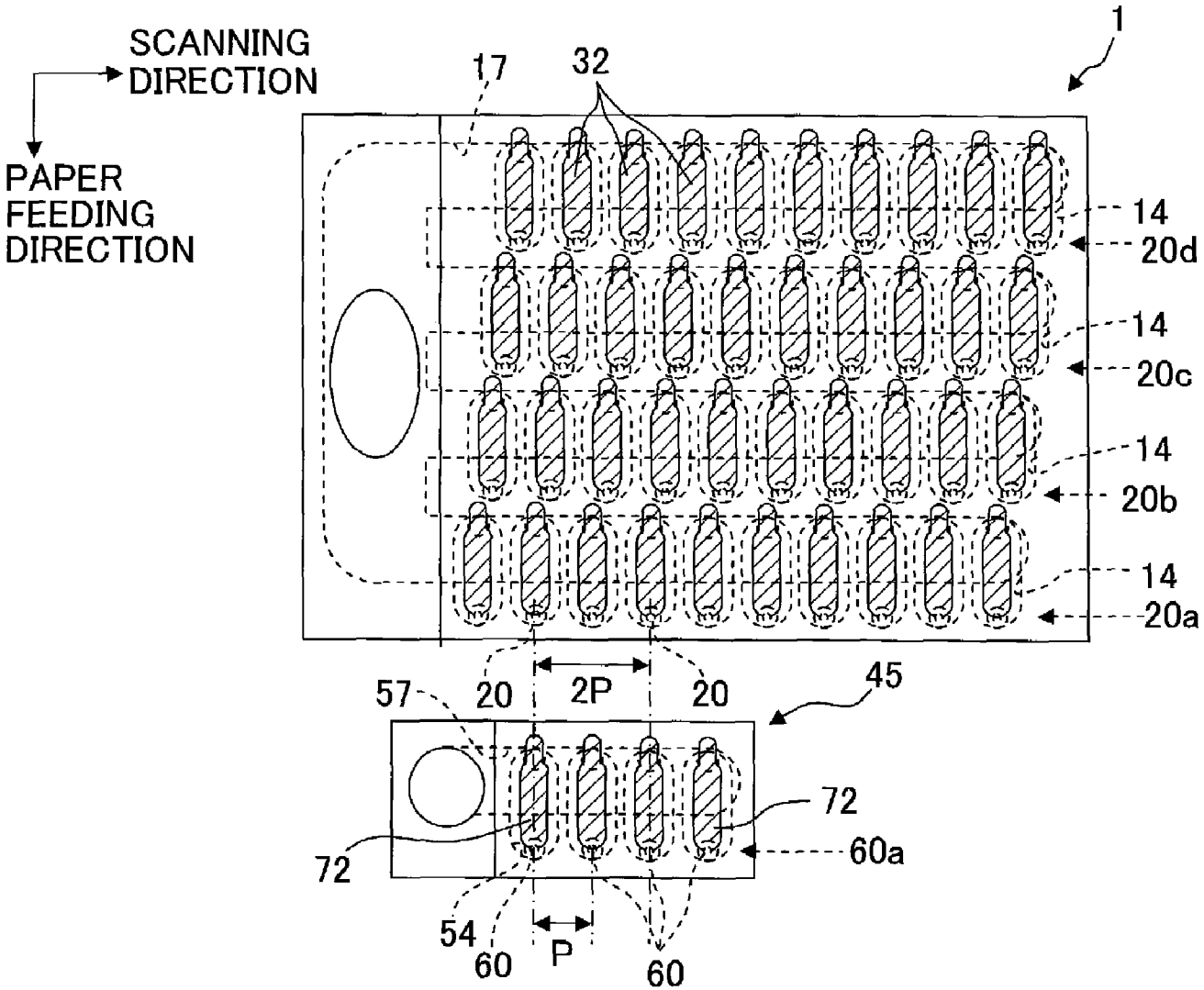
FIG. 11 is a plan view of the line-type ink-jet head and the auxiliary head during the substitute jetting.

The auxiliary head control section 83 includes a jetting-position determining section 83*a* (jetting-position determining section) which determines, based on the information stored in the failed-nozzle memory section 82*a*, a jetting-execution position (jetting position) for the auxiliary head 45 and a substitute nozzle which is to jet liquid droplet in place of the failed nozzle 20 upon performing substitute jetting. For example, as shown in FIG. 11, a case is considered in which the second and fourth nozzles 20 from the left in the front row or array 20*a* (row or array located at the most downstream in the paper feeding direction), are detected to be as failed nozzles by the jetting-state detection section 44. Here, since the auxiliary head 45 has the four nozzles 60 arranged in the scanning direction at the pitch P, the jetting-position determining section 83*a* determines a jetting-execution position for the auxiliary head 45 such that the two failed nozzles 20 arranged by a spacing distance of pitch 2P and any two of the nozzles 60 in the auxiliary head 45, which are arranged by a spacing distance of the pitch 2P, are located at positions, respectively, which are same with respect to the scanning direction (positions indicated by one-dot chain lines in FIG. 11). Further, the jetting-position determining section 83*a* determines, when the auxiliary head 45 is located at this jetting-execution position, that these two nozzles 60 located at the same positions as those of the two failed nozzles 20 in the scanning direction, as the substitute nozzles.

After the jetting-execution position for the auxiliary head 45 and the substitute nozzles have been determined in this manner, when a print command is inputted from the input device 85 to the head control section 80, the head control section 80 controls the driver IC 22 so that the ink is jetted only from the normal nozzles 20 other than the failed nozzles 20 which have been detected; and the head control section 80 outputs, to the auxiliary head control section 83, a command for substitute jetting to substitute for (complement) the failed nozzles. Then, the auxiliary head control section 83 controls, based on the positional information from the linear encoder 49, the head drive motor 48 to move the auxiliary head 45 to the jetting-execution position determined by the jetting-position determining section 83*a*. Further, the auxiliary head control section 83 controls the driver IC 73 of the auxiliary head 45 so that the ink is jetted from the substitute nozzles 60 determined by the jetting-position detector 83*a*, thereby complementing the failed nozzles 20 in the ink-jet head 1.

In this manner, even when the jetting failure occurs concurrently at nozzles 20 among the plurality of nozzles 20 in the ink-jet head 1, in a case that the failed nozzles 20 are adjacent to each other, or the failed nozzles 20 are not adjacent with each other but arranged by a spacing distance of not more than pitch 3P, the auxiliary head 45 can be fixed at one jetting-execution position without being moved from the jetting-execution position, thereby making it possible to complement the failed nozzles 20 at one time by the four nozzles 60. Thus, it is possible to perform the substitute jetting effectively.

In the jetting failure state in the ink-jet head 1 as shown in FIG. 11, it is also possible to determine, by the jetting position determining section 83, two different jetting-execution positions for the two failed nozzles 20, respectively, and to move the auxiliary head 45 between these two jetting-execution positions, thereby complementing the two failed nozzles 20 separately. In this case, however, it is necessary to move the auxiliary head 45 in the scanning direction every time the substitute jetting is performed for each of the two failed nozzles 20. Therefore, this makes the substitute jetting less efficient and it is difficult to perform the substitute jetting quickly. To address this situation, the jetting-position determining section 83*a* determines the jetting-execution position and substitute nozzle or nozzles by reducing the number of the jetting-execution position (one position in the example shown in FIG. 11) so as to preventing, as much as possible, the auxiliary head from moving unnecessarily when the substitute jetting is performed.

Figure 12:
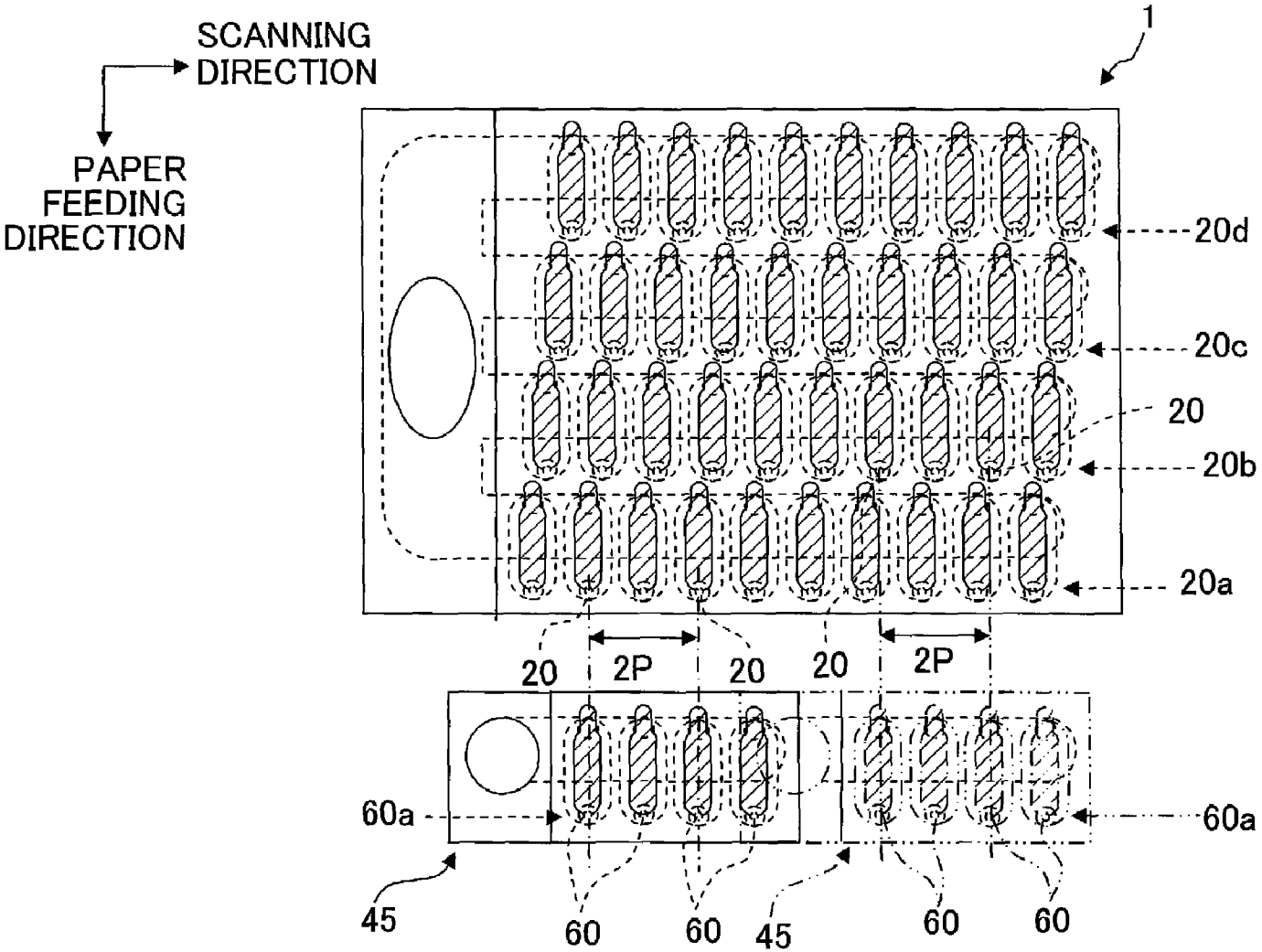
FIG. 12 is a plan view of another line-type ink-jet head and another auxiliary head, during the substitute jetting.

On the other hand, as shown in FIG. 12, when it is detected that the jetting failure occurs at the two nozzles 20 belonging to the front nozzle row 20*a*, as well as at the second and fourth nozzles 20 from the left belonging to the second nozzle row 20*b*, then it is not possible for the auxiliary head 45 to complement the four failed nozzles concurrently at one jetting-execution position. Accordingly, it is necessary to move the auxiliary head 45 in the scanning direction. However, in this case also, the jetting-position determining section 83*a* of the auxiliary head control section 83 determines the jetting-execution position and substitute nozzle or nozzles such that the number of the jetting-execution position for the auxiliary head 45 is small. Namely, when two failed nozzles 20, located in the front nozzle row 20*a* by a spacing distance of 2P, are to be substituted, the jetting-execution position for the auxiliary head 45 is determined to be at a position at which the auxiliary head 45 is indicated by solid lines in FIG. 12, such that these two failed nozzles 20 can be complemented at one time. On the other hand, when two failed nozzles 20, located in the second nozzle row 20*b* by a spacing distance of 2P, are to be complemented, the jetting-execution position for the auxiliary head 45 is determined to be at a position at which the auxiliary head 45 is indicated by two-dot chained lines in FIG. 12, such that these two failed nozzles 20 can be complemented at one time. In this manner, the jetting-position determining section 83*a* determines the jetting-execution position such that the auxiliary head 45 can complement failed nozzles 20 at one time as many as possible at one jetting-execution position. This makes it possible to reduce the number of the jetting-execution position, namely, the number of times the auxiliary head 45 is moved, upon the substitute jetting is performed, thereby performing the substitute jetting quickly.

Further, as described above, the ink channel including the nozzles 60 and the pressure chambers 54 of the auxiliary head 45; the individual electrodes 72 for applying pressure to the ink in the pressure chambers 54; and the like, are formed to have same shape and size as those in the ink-jet head 1. Accordingly, the jetting characteristics such as the velocity of liquid droplet and the volume of liquid droplet are substantially same when the ink is jetted from the nozzles 20 in the ink-jet head 1 and when the ink is jetted from the nozzles 60 in the auxiliary head 45. Therefore, the printing quality hardly changes by the substitute jetting with the auxiliary head 45.

According to the ink-jet printer 100 as explained above, the following effects can be obtained. The auxiliary head 45 has the four nozzles 60 which are arranged in an array in the scanning direction at a pitch P which is same as that at which the nozzles 20 are arranged in each of the nozzle rows 20*a* to 20*d* in the line-type ink-jet head 1. Accordingly, even when the jetting failure occurs concurrently at nozzles 20 among the plurality of nozzles 20 in the ink-jet head 1, it is possible to complement these failed nozzles 20 at one time. Further, since it is possible to effectively complement the failed nozzles 20 by the auxiliary head 45 having a number of nozzles substantially smaller than that of the nozzles in the line-type ink-jet head 1, the cost for producing the ink-jet printer 100 can be suppressed to be lower than in a case in which an auxiliary head, that is same line-type head as the ink-jet head 1, is separately provided for the substitution (complementary) purpose.

Furthermore, since the jetting-state detector 44 can automatically identify a nozzle 20 at which the jetting failure occurs, it is possible to quickly perform the substitute jetting by the auxiliary head 45. Moreover, the jetting-position determining section 83*a* of the auxiliary head control section 83 determines, based on an information for identifying a failed nozzle or nozzles stored in the failed-nozzle memory section 82*a*, the jetting-execution position and substitute nozzle or nozzles such that the number of jetting-execution position for the auxiliary head 45 is small. Accordingly, the number of movement of the auxiliary head 45 becomes small, thereby making it possible to perform the substitute jetting effectively and quickly.

Next, an explanation will be given about modifications in each of which various changes are made to the first embodiment. Parts or components of the modification, which are same in construction as those in the first embodiment, will be assigned with same reference numerals and any explanation therefor will be omitted as appropriate.

A line-type ink-jet head may be constructed to have a plurality of nozzle rows (arrays) aligned in the paper feeding direction, and an auxiliary head may be constructed to also have a plurality of nozzle rows (arrays) aligned in the paper feeding direction such that the auxiliary head can complement, at one time, failed nozzles each of which belongs to one of the plurality of nozzle rows in the ink-jet head.

Figure 13:
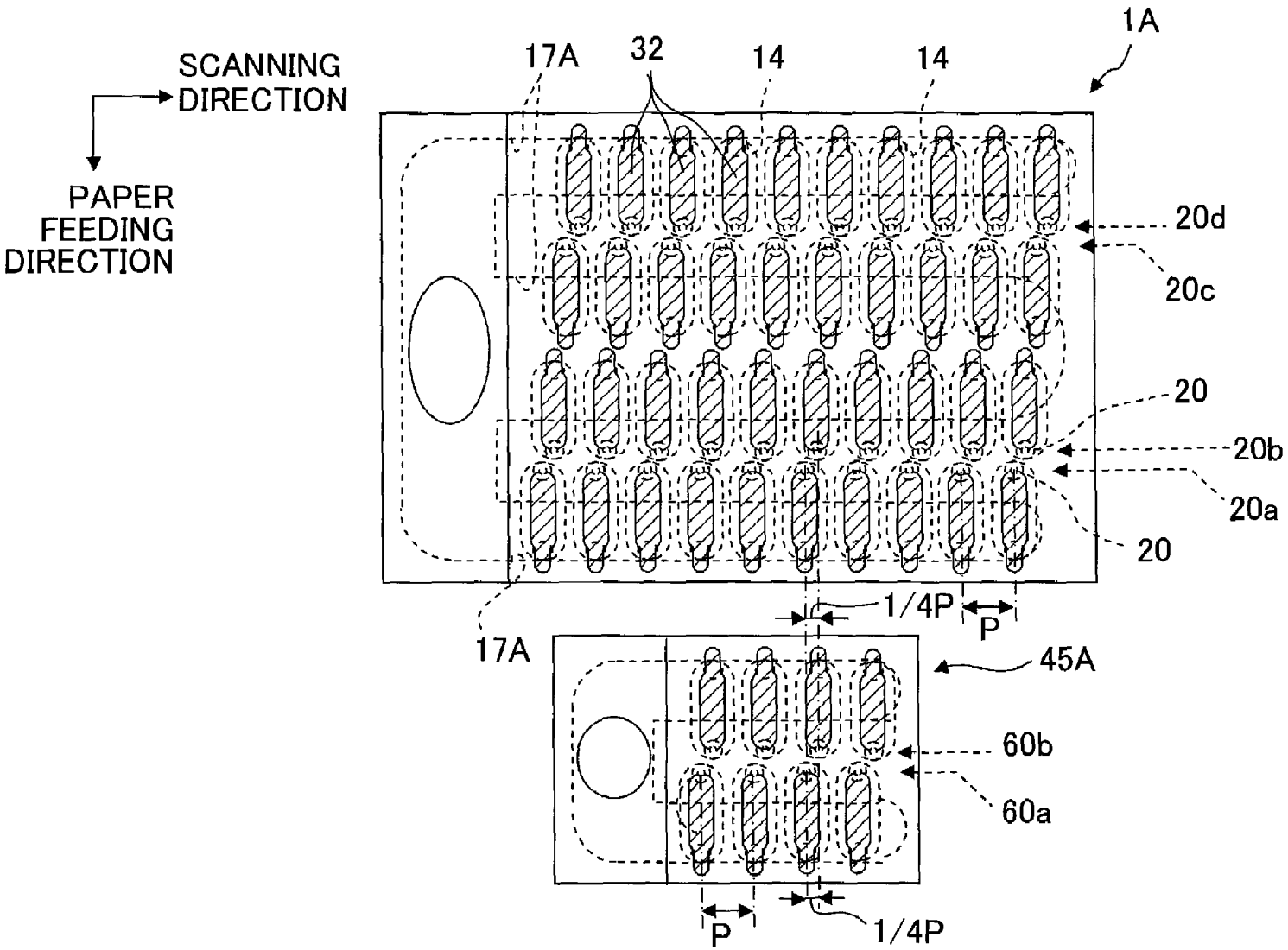
FIG. 13 is a plan view of a line-type ink-jet head and an auxiliary head according to a first modification of the first embodiment, during the substitute jetting.

For example, a line-type ink-jet printer 1A as shown in FIG. 13 has four nozzle rows (arrays) 20*a* to 20*d* which are aligned in the paper feeding direction (posterior-anterior direction in FIG. 13) and each of which is constructed of a plurality of nozzles 20 arranged in the scanning direction. With respect to the four nozzle rows 20*a* to 20*d*, the pitch P at which the nozzles 20 are arranged, is same in all of the nozzle rows 20*a* to 20*d*. Further, a shift amount by which nozzles in two adjacent nozzle rows (between the nozzle rows 20*a* and 20*b*, between the nozzle rows 20*b* and 20*c*, and between the nozzle rows 20*c* and 20*d*), among the nozzles rows 20*a* to 20*d*, are shifted from each other in the scanning direction, is ¼ of the pitch P. In this case, the shift amount is an amount of a positional shift, between the nozzles each belonging to one of the two adjacent nozzle rows, in the scanning direction. Furthermore, the nozzle arrays 20*a*, 20*b* which are two front nozzle rows (downstream in the paper feeding direction in FIG. 13) are arranged to be adjacent to each other in the paper feeding direction; and the nozzle rows 20*c*, 20*d* which are two rear nozzle rows (upstream in the paper feeding direction in FIG. 13) are arranged to be adjacent to each other in the paper feeding direction.

Moreover, in the ink-jet head 1A, three manifold 17A extending in the scanning direction are formed. The nozzle row 20*a* which is the front row and the nozzle row 20*d* which is the fourth row from the front are communicated with two manifolds 17A located at both ends, respectively, among the three manifolds 17A, via the pressure chambers 14. On the other hand, nozzles 20 each belonging to one of the nozzle rows 20*b* and 20*c* which are the second and third rows from the front, respectively, are commonly communicated with a central manifold 17A (liquid chamber), each via one of the pressure chambers 14 at a lower end (communicating port) of one of the communication holes 15. Further, communication holes 15 communicating with the nozzles 20 in the nozzle row 20*b* which is the second row and communication holes 15 communicating with the nozzles 20 in the nozzle row 20*c* which is the third row are arranged to be closely to one another in the scanning direction.

When the two adjacent nozzle rows (nozzle rows 20*a* and 20*b*, and nozzle row 20*c* and 20*d*) are arranged closely to each other in the paper feeding direction in such a manner, an ink, which adheres to a portion around a certain nozzle 20 belonging to one of the two adjacent nozzle rows, also adheres to a portion around another nozzle 20 belonging to the other of the two adjacent nozzle rows, thereby easily causing the jetting failure concurrently at not less than two nozzles 20 each belonging to one of the two nozzle rows. In addition, two nozzles 20, each of which belongs to one of the two central nozzle rows 20*b* and 20*c* and which are arranged to shift from each other by an amount of ¼ of the pitch P in the scanning direction, are communicated with the common manifold 17A via two communication holes 15, respectively, and these two communication holes 15 themselves are arranged closely to each other. In this case, therefore, when a large air bubble enters into the common manifold 17A, the air bubble easily enters into the two nozzles 20 concurrently from the two communication holes 15 arranged closely to each other, thereby easily causing the jetting failure to occur concurrently at these two nozzles 20.

In view of these situations, an auxiliary head 45A of the modification is constructed to be capable of complementing, at one time, a plurality of failed nozzles 20 each belonging to one of the two adjacent nozzle rows in the ink-jet head 1A. As shown in FIG. 13, the auxiliary head 45A has two nozzle rows (arrays) 60*a*, 60*b* which are aligned in the paper feeding direction and each of which is constructed of four nozzles 60 arranged in the scanning direction. With respect to the two nozzle rows 60*a* and 60*b*, a pitch at which the nozzles 60 are arranged, is same as the pitch P at which the nozzles 20 are arranged in each of the nozzle rows 20*a* to 20*d* in the ink-jet head 1A. Further, a shift amount by which the nozzle rows 60*a* and 60*b* are shifted from each other in the scanning direction is ¼ of the pitch P. Namely, both of the pitch of the nozzles arrays 60*a*, 60*b* and the positional shift amount between the nozzles in the nozzle rows 60*a*, 60*b* in the auxiliary head 45A are same as those for the nozzles arrays 20*a* to 20*d* in the ink-jet head 1A; and when a portion of the ink-jet head 1A is cut out as a rectangular area, the nozzle arrangement in the auxiliary head 45A is same as those in the rectangular area cut out from the ink-jet head 1A.

Accordingly, even when the jetting failure occurs concurrently at not less than two nozzles 20 each belonging to one of the two adjacent nozzle rows in the ink-jet head 1A, it is possible to complement, at one time, these failed nozzles 20 in the two adjacent nozzle rows in the ink-jet head 1A, by using the nozzles 60 belonging to the two nozzle rows 60*a*, 60*b*, respectively, of the auxiliary head 45A. Also, in a case that the jetting failure occurs concurrently at two nozzle rows due to the cause such as the ink reverse flow and/or air babble entrance, as described above, the plurality of failed nozzles are arranged closely to each other in the scanning direction in many cases. Accordingly, even when the length of the nozzle rows 60*a*, 60*b* in the auxiliary head 45A is sufficiently shorter than the length of the nozzle rows 20*a* to 20*d* in the ink-jet head 1, it is possible to efficiently complement the failed nozzles 20 in the nozzle rows 20*a* to 20*d*, thereby making it possible to suppress the cost by reducing the number of the nozzles 60 in the auxiliary head 45A.

Figure 14:
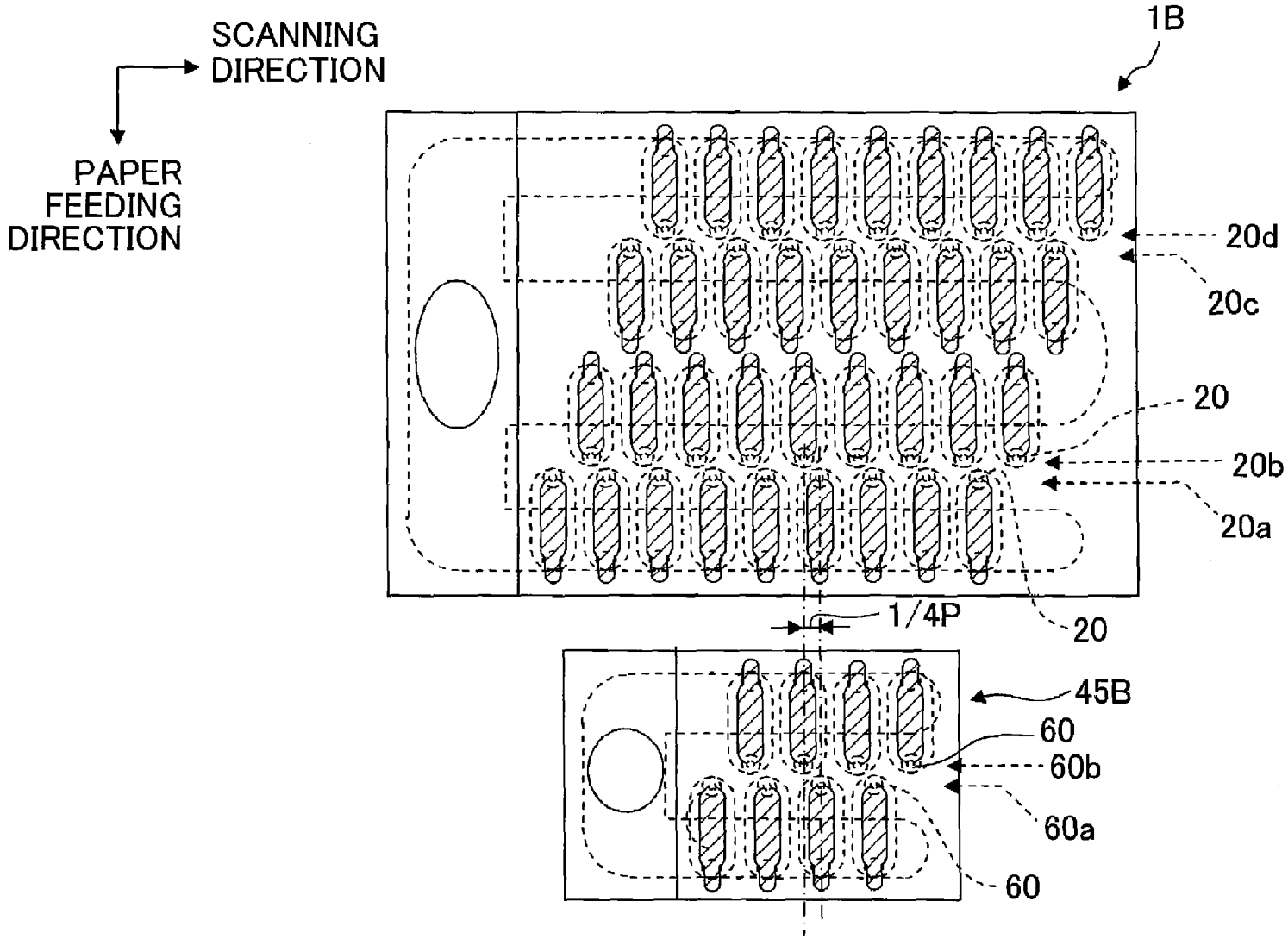
FIG. 14 is a plan view of a line-type ink-jet head and an auxiliary head according to another modification, during the substitute jetting.

It should be noted that an ink-jet head capable of complementing the failed nozzle or nozzles in the ink-jet head by the auxiliary head having two nozzle rows as described above, is not limited to one having the nozzle arrangement as shown in FIG. 13. For example, as shown in FIG. 14, two adjacent nozzle rows may be shifted from each other, with respect to the scanning direction in the ink-jet head, in a direction opposite to that in which the two adjacent nozzle rows as shown in FIG. 13 are shifted from each other. Namely, in the ink-jet head 1A shown in FIG. 13, the second nozzle row 20*b* is shifted from the front nozzle row 20*a* rightward by ¼ of the pitch P. On the other hand, in an ink-jet head 14B shown in FIG. 14, the second nozzle row 20*b* is shifted from the front nozzle row 20*a* leftward by ¼ of the pitch P. For such an ink-jet head 1B also, it is possible to perform the complement effectively with an auxiliary head 45B by making the pitch between two nozzle rows 60*a*, 60*b* and a shift amount between the nozzle rows in the auxiliary head 45B to be same as those for the nozzle arrays 20*a* to 20*d* in the ink-jet head 1B.

Figure 15:
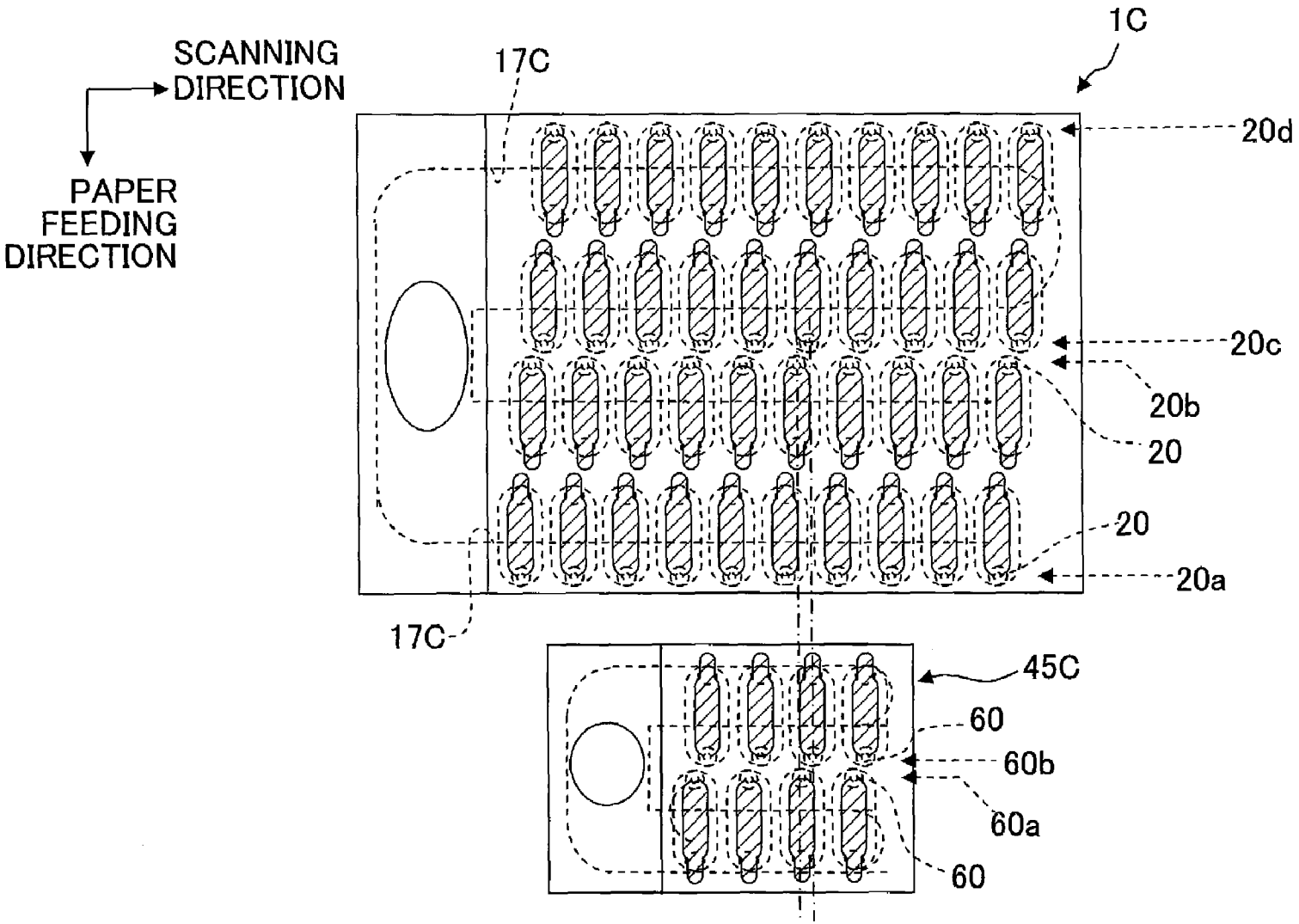
FIG. 15 is a plan view of a line-type ink-jet head and an auxiliary head according to still another modification, during the substitute jetting.

Alternatively, the positions of two mutually adjacent nozzle rows and the positions of two nozzle rows communicating with a common manifold may be opposite as those in FIG. 13. Namely, in an ink-jet head 1C as shown in FIG. 15, among four nozzle rows (arrays) 20*a* to 20*d*, nozzle rows 20*b* and 20*c* which are second and third nozzle rows from the front are adjacent to each other in the paper feeding direction. On the other hand, a nozzle row 20*a* which is the front nozzle row and the nozzle row 20*b* which is the second nozzle row are communicated with a manifold 17C located at the anterior portion side of the ink-jet head 1C (downstream in the paper feeding direction), and the nozzle row 20*c* which is the third nozzle row from the front and a nozzle row 20*d* which is the fourth nozzle row from the front are commonly communicated with a manifold 17C located at the posterior portion side of the ink-jet head 1C (upstream in the paper feeding direction). For such an ink-jet head 1C also, it is possible to perform the complement effectively with an auxiliary head 45C by making the pitch between two nozzle rows 60*a*, 60*b* and a shift amount between the nozzle rows in the auxiliary head 45C to be same as those for the nozzle arrays 20*a* to 20*d* in the ink-jet head 1C.

It is not necessarily indispensable that the nozzle rows (arrays) in the line-type ink-jet head are four rows (arrays). Instead, it is possible to freely determine the number of nozzle rows in accordance with various design conditions such as required graphic mode (resolution) and the like. Further, it is not necessarily indispensable that the nozzle rows (arrays) in the auxiliary head are two rows (arrays) and the number of nozzle rows in the auxiliary head can be appropriately changed in accordance with the nozzle arrangement conditions in the line-type ink-jet head such as the state of proximity between the nozzle rows, the number of nozzle rows communicating with one manifold, and the like.

Figure 17A:
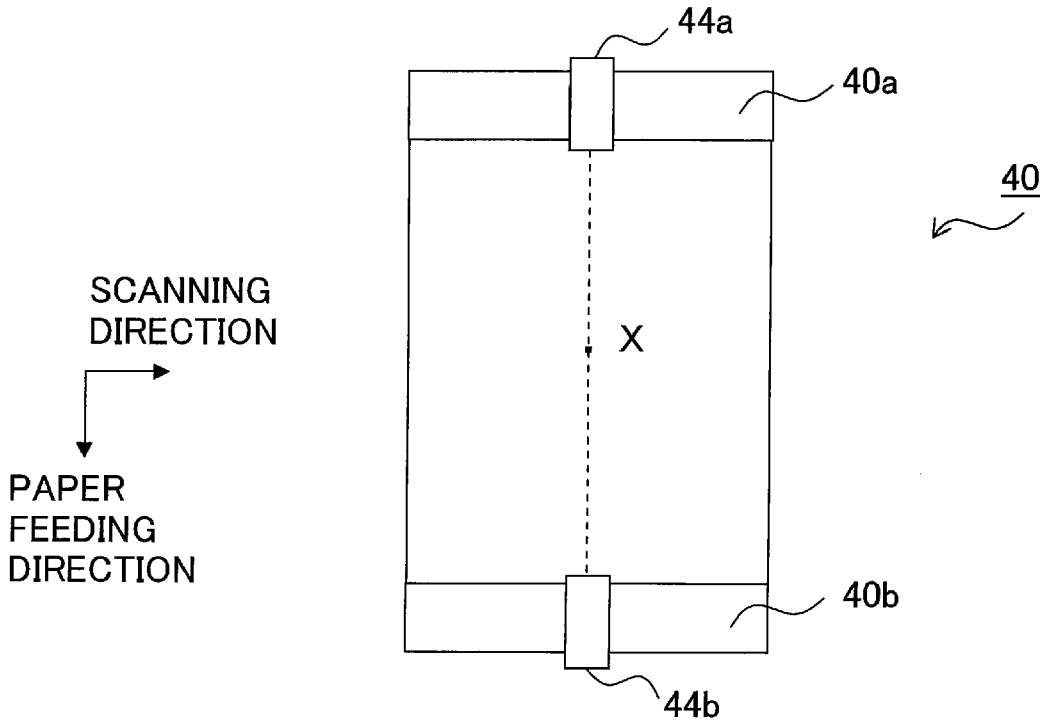
FIG. 17A is a plan view showing a movable body of the first embodiment as viewed from a side of the liquid-droplet jetting surface of the ink-jet head.

FIG. 17 is a drawing showing a movable body 40 in the first embodiment, as viewed from a side of the liquid-droplet jetting surface 1*a* of the ink-jet head 1. In the first embodiment, when a liquid droplet jetted from a nozzle does not passes through laser beam emitted from the light emitting element 44*a* to the light receiving element 44*b*, it is detected that the jetting state of the nozzle is abnormal. Namely, when the liquid droplet jetted from the nozzle passes on a trajectory or light path (indicated by dashed line in FIG. 17A), the liquid droplet consequently blocks the laser beam, and thus the jetting state of the nozzle is detected to be normal in the jetting direction. More specifically, even when the liquid droplet blocks the laser beam at a position, which is offset, on the light path of the laser beam, from a desired position (in the vertical direction downward from the jetting port of the nozzle), such a offset cannot be detected by the detection system (detector) as shown in FIG. 17A. In the following, an explanation will be given about a modification for solving the problem.

Figure 17B:
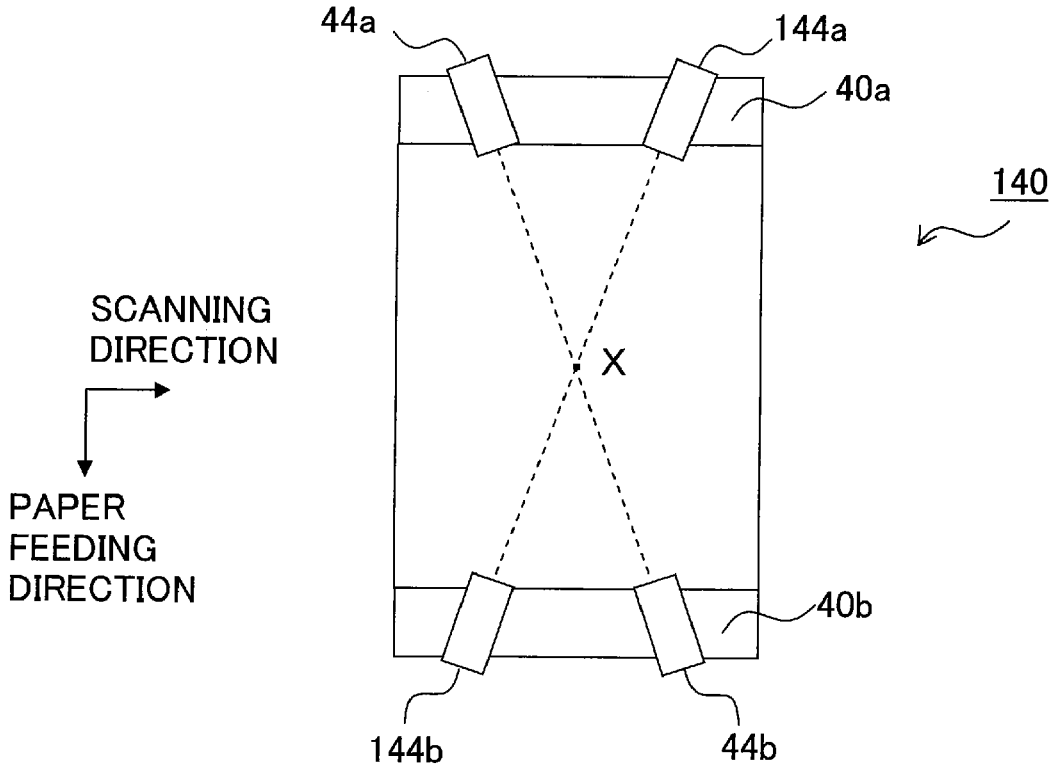
FIG. 17B is a plan view showing a movable body of the modification of the first embodiment as viewed from a side of the liquid-droplet jetting surface of the ink-jet head.

A movable body 140 as shown in FIG. 17B has a first light-emitting element 44*a* and a second light-emitting element 144*a* which are attached to a wall 40*a* and a second light-receiving element 44*b* and a second light-receiving element 144*b* which are attached to a wall 40*b*. A first laser beam 151 emitted from the first light-emitting element 44*a* passes through a desired position X (vertically downward position from the jetting port of the nozzle), and then is received by the first light-receiving element 44*b*. A second laser beam 152 emitted from the second light-emitting element 144*a* passes through the desired position X, and then is received by the second light-receiving element 144*b*. The first light-emitting element 44*a* and the first light-receiving element 144*a* are arranged such that the light path of the first laser beam 151 is inclined with respect to the paper feeding direction; and the second light-emitting element 44*b* and the second light-receiving element 144*b* are arranged such that the light path of the second laser beam 152 is inclined with respect to the paper feeding direction and is intersected with the first laser beam 151 at the position X. According to such a construction, when it is detected that the light reception is blocked (interrupted) by the liquid droplet both at the first and second light-receiving elements 44*b* and 144*b*, it is appreciated that the liquid droplet is jetted onto the desired position X. Here, the first light-emitting element 44*a* and the first light-receiving element 44*b* may be arranged such that the light path of the first laser beam 151 is parallel to the paper feeding direction and passes thorough the position X. In this case, the second light-emitting element 144*a* and the second light-receiving element 144*b* may be arranged such that the light path of the second laser beam 152 is inclined with respect to the light path of the first laser beam 151 and is intersected with the first laser beam 151 at the position X.

Figure 18A:
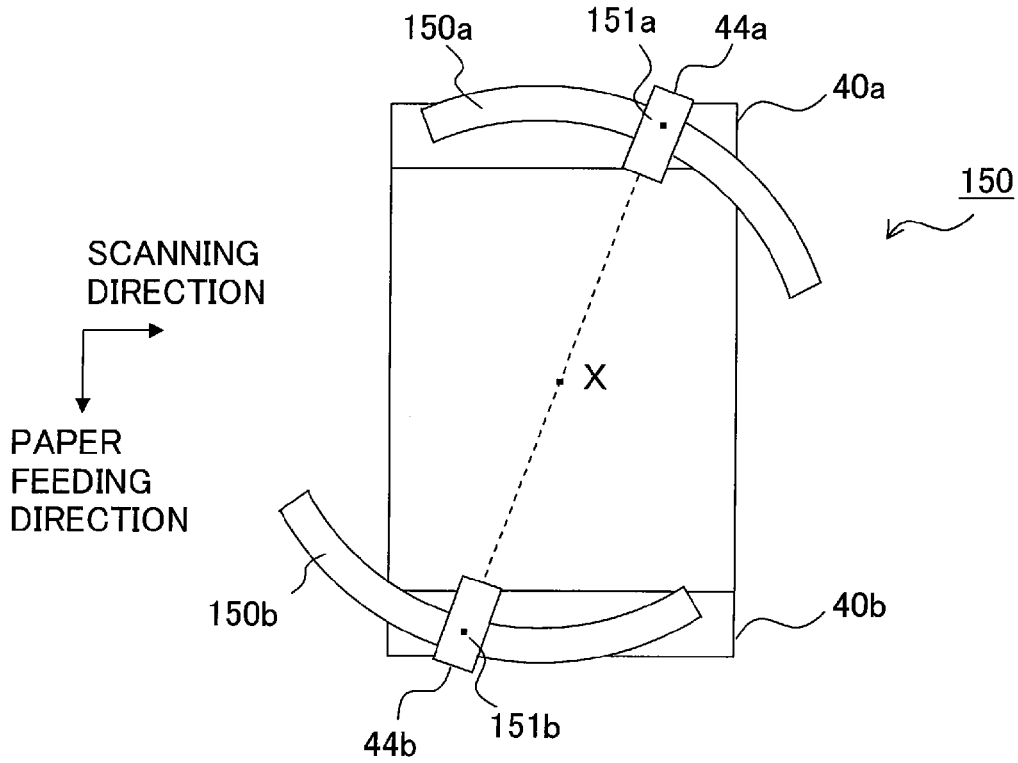
FIGS. 18A and 18B are each a plan view showing a movable body of still another modification of the first embodiment as viewed from a side of the liquid-droplet jetting surface of the ink-jet head.
Figure 18B:
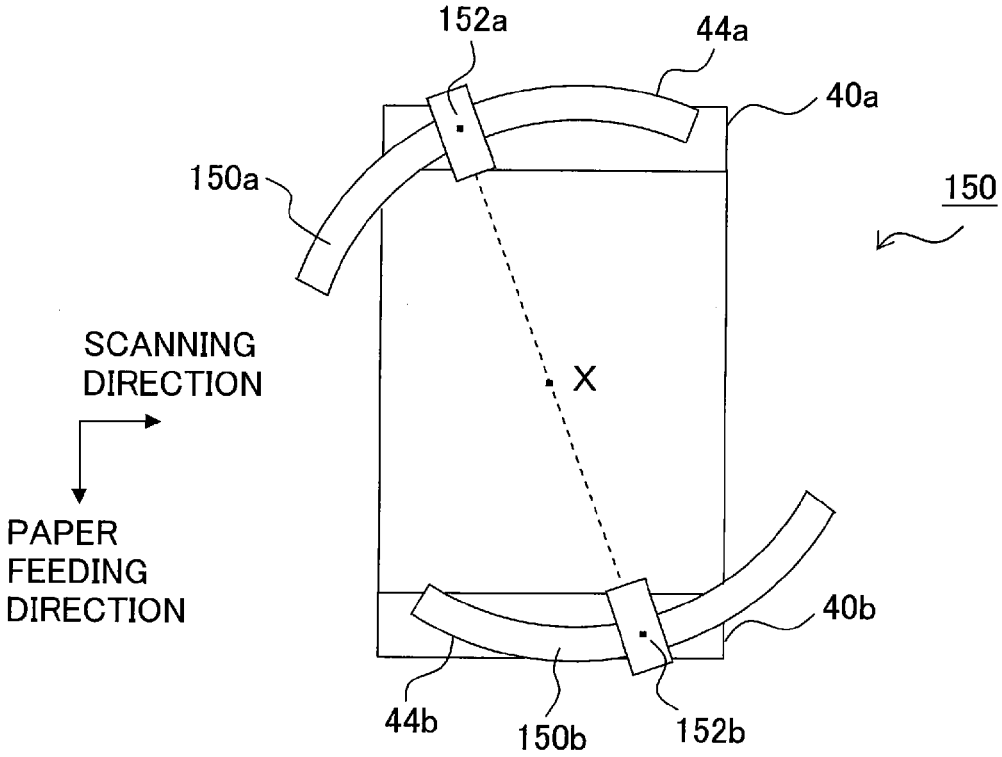

Further, a movable body 150 of another modification as shown in FIGS. 18A and 18B includes a first semicircular (arched) arm 150*a* pivotably (swingably) attached to a wall 40*a*; a second semicircular (arched) arm 150*b* pivotably attached to a wall 40*b*; a light emitting element 44*a* attached to the first semicircular arm 150*a*; a light receiving element 44*b* attached to the second semicircular arm 150*b*; and a drive motor (not shown) which is provided on a lower portion of the movable body 150 and which causes the first and second semicircular arms 150*a* and 150*b* pivot along the walls 40*a* and 40*b*, respectively. The first and second semicircular arms 44*a* and 44*b* are connected to each other by a supporting section (not shown) which extends in a radial direction of the semicircular arms. The supporting section is axially supported, by a spindle (not shown) of the drive motor, at the central portion in the longitudinal direction of the supporting section. When the first and second semicircular arms 44*a* and 44*b* are driven by the drive motor to pivot along the walls 40*a* and 40*b*, respectively, with a desired position X (vertically downward position from the jetting port of the nozzle) as the pivot center (pivot point), the light emitting element 44*a* can move between a first position (151*a*) as shown in FIG. 18A and a second position (152*a*) as shown in FIG. 18B and the light receiving element 44*b* can move between a first position (151*b*) as shown in FIG. 18A and a second position (152*b*) as shown in FIG. 18B. The light emitting element 44*a* and the light receiving element 44*b* are arranged on the first and second semicircular arms, respectively, such that the laser beam, which is emitted from the light emitting element 44*a* at the first position (151*a*), passes through the desired position X and then is received by the light receiving element 44*b* at the first position (151*b*); and that the laser beam, which is emitted from the light emitting element 44*a* at the second position (152*a*), passes through the desired position X and then is received by the light receiving element 44*b* at the second position (152*b*). First, the first and second semicircular arms are pivoted such that the light emitting element 44*a* and the light receiving element 44*b* are arranged at the first positions (151*a*, 151*b*), respectively, and it is detected at the light receiving element 44*b* whether or not the laser beam emitted from the light emitting element 44*a* is blocked by a liquid droplet jetted from the nozzle. When it is detected that the laser beam is blocked by the liquid droplet, it is appreciated that the liquid droplet is jetted on the light path of the laser beam between the first positions (151*a*, 151*b*). Next, the first and second semicircular arms are pivoted such that the light emitting element 44*a* and the light receiving element 44*b* are arranged at the second positions (152*a*, 152*b*), respectively, and it is detected at the light receiving element 44*b* whether or not the laser beam emitted from the light emitting element 44*a* is blocked by a liquid droplet jetted from the nozzle. When it is detected that the laser beam is blocked by the liquid droplet, it is appreciated that the liquid droplet is jetted on the light path of the laser beam at the second positions (152*a*, 152*b*). According to such a construction, when it is detected that the laser beam is blocked with the light receiving element 44*b* at both the first and second positions (151*b*, 152*b*), it is appreciated that the liquid droplet is jetted onto the desired position X. It should be noted that the light emitting element 44*a* and the light receiving element 44*b* need not be moved (pivoted) between the first and second positions, respectively, every time that each of the nozzles is inspected. For example, all the nozzles may be inspected in a state that the light emitting element 44*a* and the light receiving element 44*b* are arranged at the first positions (151*a*, 151*b*), respectively; then the light emitting element 44*a* and the light receiving element 44*b* are moved to be arranged at the second positions (152*a*, 152*b*), respectively; and then all the nozzles may be inspected in a state that the light emitting element 44*a* and the light receiving element 44*b* are arranged at the second positions (152*a*, 152*b*), respectively.

It is not necessarily indispensable that the failed-nozzle detector which detects a failed nozzle 20 is not limited to that of the optical type such as the jetting-state detector 44 having the light emitting element 44*a* and the light receiving element 44*b* in the first embodiment as described above. Instead, a various type of detectors can be used. For example, the failed-nozzle detector may have a construction in which an electrode is provided on a surface, of the movable body 40, facing the liquid-droplet jetting surface 1*a*, and when a liquid droplet of a charged ink is jetted toward the electrode, the landing position of the liquid droplet is recognized or confirmed by the voltage change in the surface of electrode, thereby detecting the jetting state of each of the nozzles 20. Alternatively, the failed-nozzle detector may have a construction in which a nozzle check pattern is printed and a lack or blank portion or portions in the nozzle check pattern is read by an image reading device such as a scanner, thereby detecting a failed nozzle or nozzles 20.

Further alternatively, the failed-nozzle detector may be omitted. For example, the user may identify a failed nozzle or nozzles 20 by checking a printed nozzle check pattern or the like, and the user may input, via the input device 85, information regarding the failed nozzle or nozzles 20 to the control unit of the printer.

Figure 19:
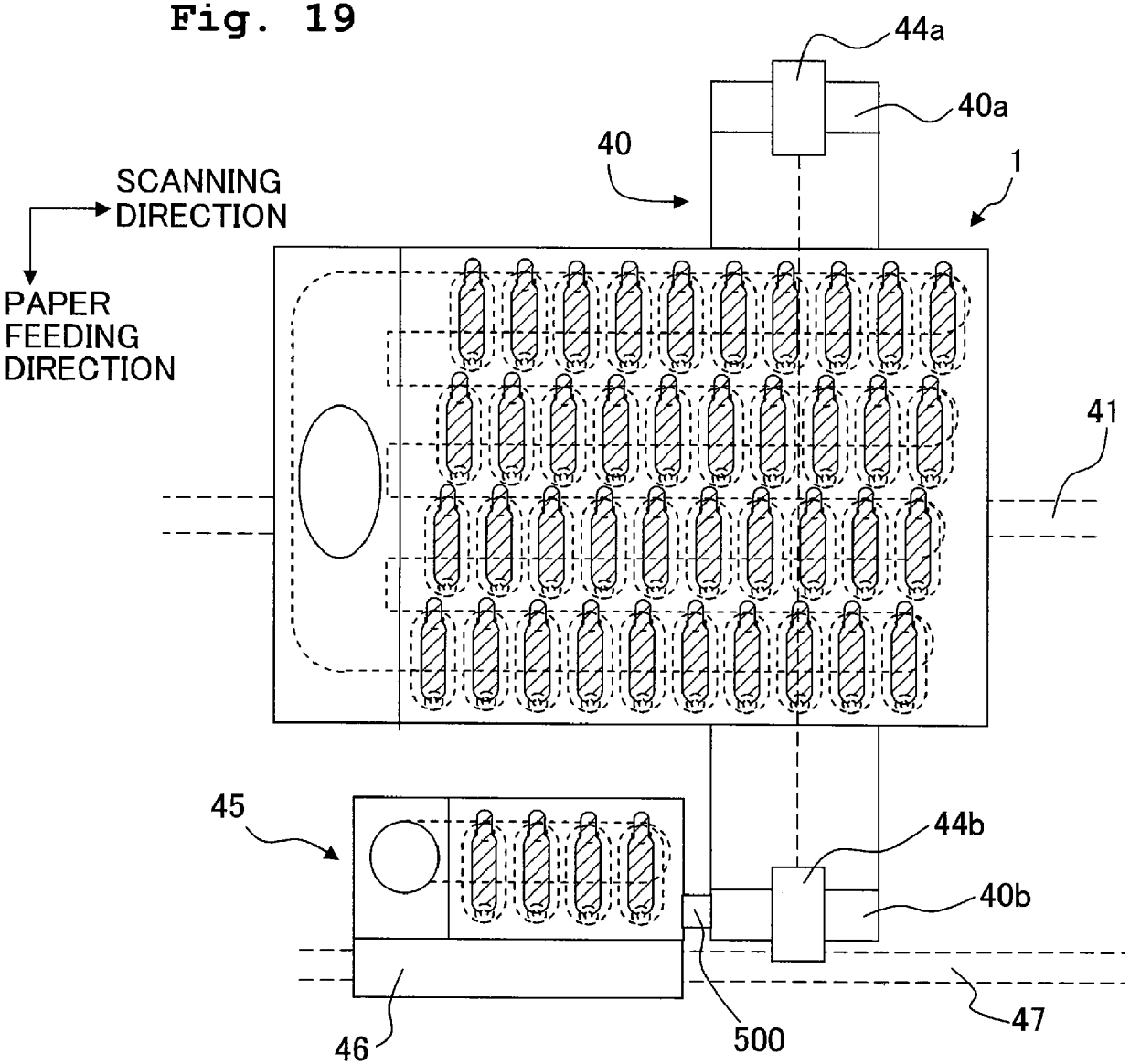
FIG. 19 is a plan view showing a construction for integrally moving the movable body and the auxiliary head.

In the above-described first embodiment, the movable body 40 is driven by the movable-body drive motor 42 in the scanning direction, and the auxiliary head 45 is driven by the head drive motor 48 in the scanning direction. However, the construction for driving the movable body 40 and the auxiliary head 45 in the scanning direction is not limited to the above construction. For example, as shown in FIG. 19, there is provided a connector 500 which connects the movable body 40 and the auxiliary head 45 so as to connect the movable body 40 and the auxiliary head 45. Then, by supplying drive force only to one of the movable body 40 and the auxiliary head 45 so as to move the movable body 40 and the auxiliary head 45 integrally in the scanning direction. By this construction, it is possible to use a drive motor commonly for both of the movable body 40 and the auxiliary head 45, instead of providing two motors for the movable head 40 and the auxiliary head 45, respectively. Namely, the number of the motor can be reduced to one, thereby making the product compact and reducing the manufacturing cost with the reduced parts numbers. Here, in place of the connector 500, an engaging claw, for example, may be provided on one of the movable body 40 and the auxiliary head 45 and an engaging-claw receiving section may be provided on the other of the movable body 40 and the auxiliary head 45, so as to connect the movable body 40 and the auxiliary head 45. Alternatively, magnets having opposite polarities may be attached detachably to the movable body 40 and the auxiliary head 45, respectively, so as to engage the movable body 40 and the auxiliary head 45 by magnetic force of the magnets. Still alternatively, when drive force is applied to the movable body 40 to move the movable body 40 and the auxiliary head 45 integrally, the carriage 46 and the guide shaft 47 for driving the auxiliary head 45 may be omitted.

Figure 20:
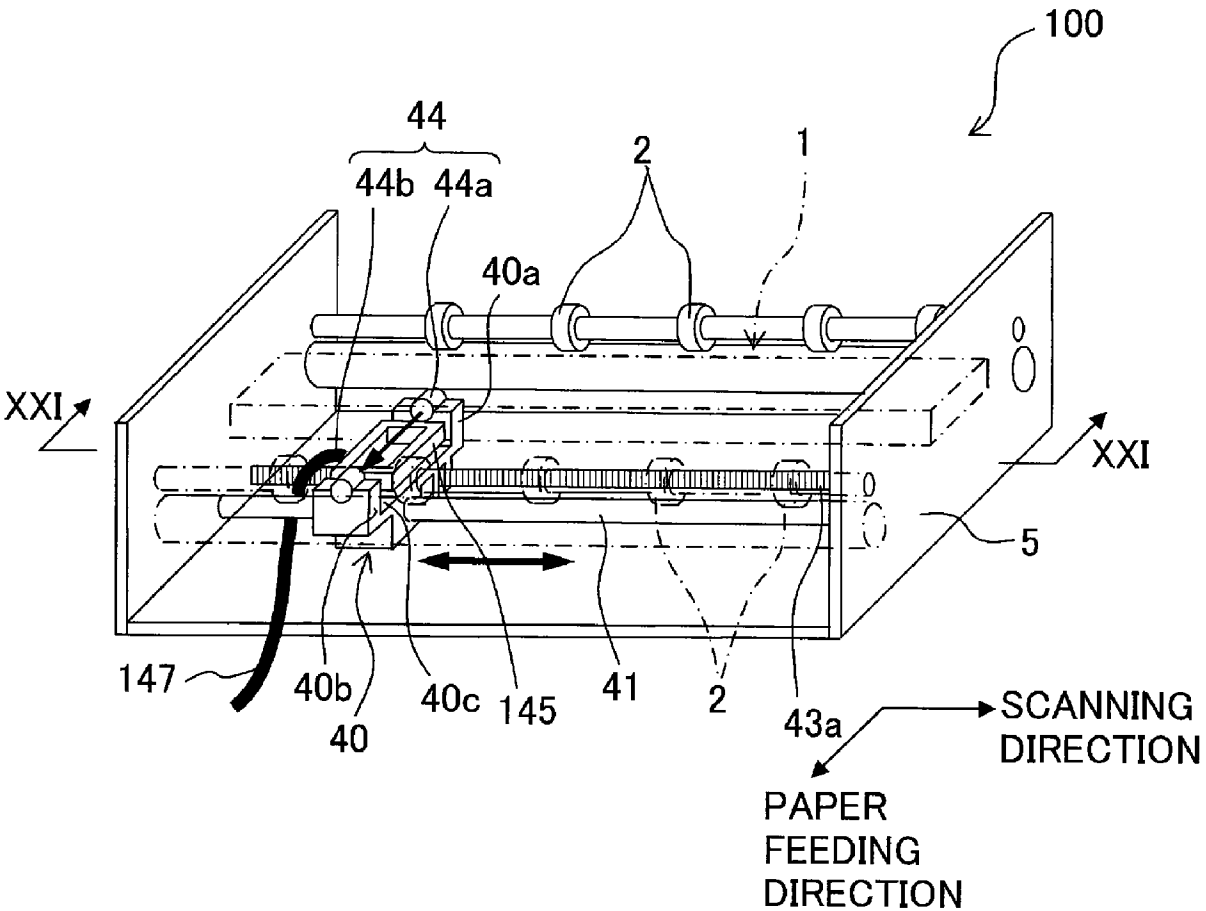
FIG. 20 is a perspective view showing a construction for purging a nozzle at which jetting failure occurs (failed nozzle).

In the first embodiment, the jetting-state detector 44, which detects the jetting state at each of the nozzles 20, is provided on the movable body 40 at the upper portion thereof. However, in this modification, as shown in FIG. 20, a purge cap 145, which covers jetting ports of the nozzles, is arranged in a recess 40*c* located at a center portion between the two walls 40*a*, 40*b* of the movable body 40. The purge cap 145 has a rectangular shape in a plan view and is elongated in a front and back (anterior and posterior) direction (paper feeding direction). The purge cap 145 is movable in the scanning direction integrally with the movable body 40. Further, the movable body 40 is provided with a cap drive motor (not shown) which drives the purge cap 145 vertically. The purge cap 145 is constructed such that the purge cap 145 is driven by the cap drive motor to be movable from a purge position (position indicated by dashed lines in FIG. 21) on an upper side at which the purge cap 145 makes contact with the liquid droplet jetting surface 1*a* to a purge standby position (position indicated by solid lines in FIG. 21) at which the purge cap 145 is accommodated in the recess 40*c* below the liquid droplet jetting surface 1*a*. Note that the purge cap 145 may be formed with a material having a certain level of flexibility such as a synthetic resin material, a rubber material or the like so that the purge cap 145 can be in contact with the liquid droplet jetting surface 1*a* tightly and securely.

Figure 21:
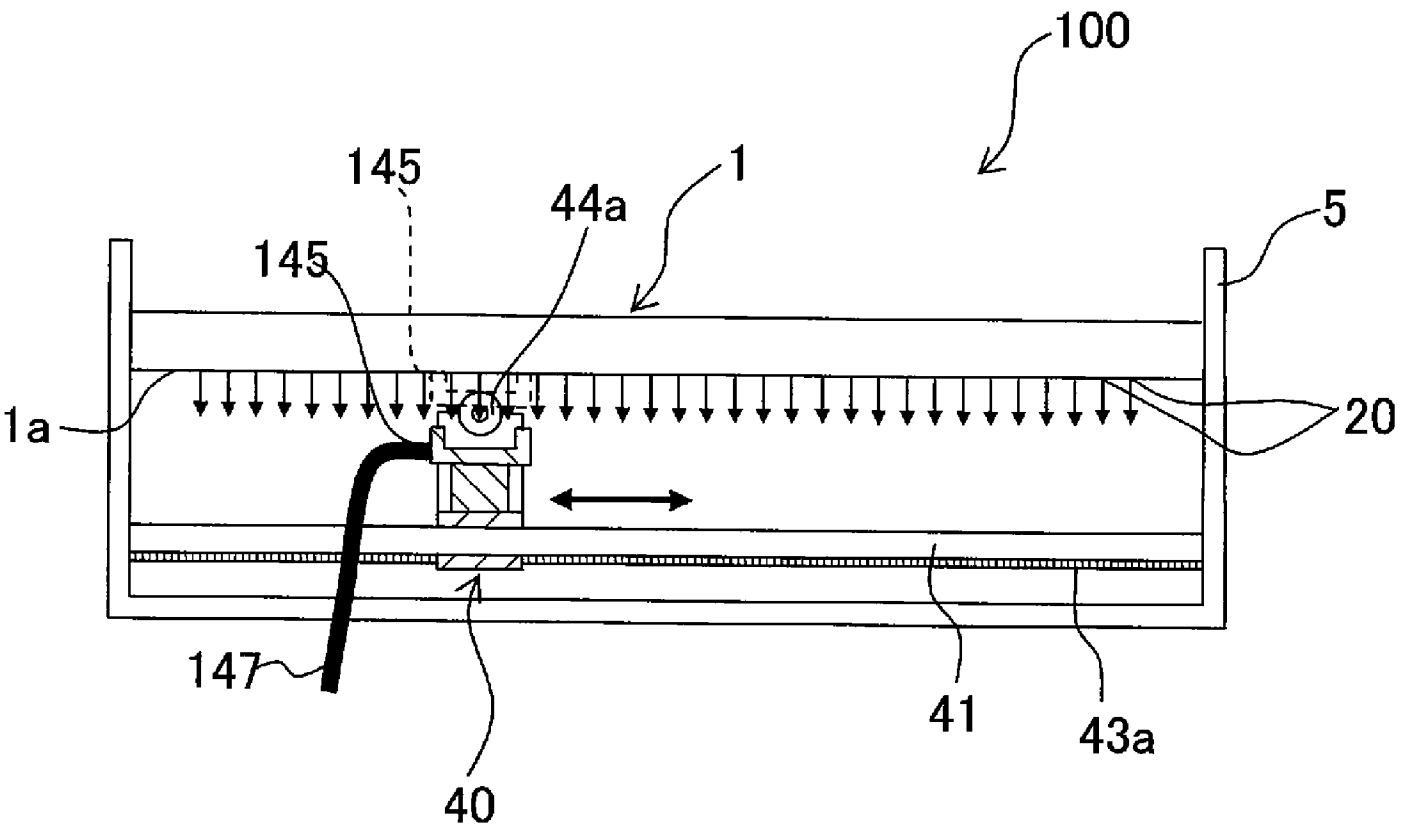
FIG. 21 is a cross-sectional view taken along a line XXI-XXI in FIG. 20.

Furthermore, as shown in FIGS. 20 and 21, a suction pump (not shown) is connected to the purge cap 145 via a tube 147. Then, in a state that the purge cap 145 is at the purge position, the ink inside nozzles 20 covered by the purge cap 145 is sucked out forcibly, and then is discharged from the tube 147. With this construction, when jetting abnormality (jetting failure) is detected at a nozzle 20 among the nozzles 20, it is possible to purge the nozzle 20 immediately to recover the nozzle from the jetting abnormality.

Figure 22:
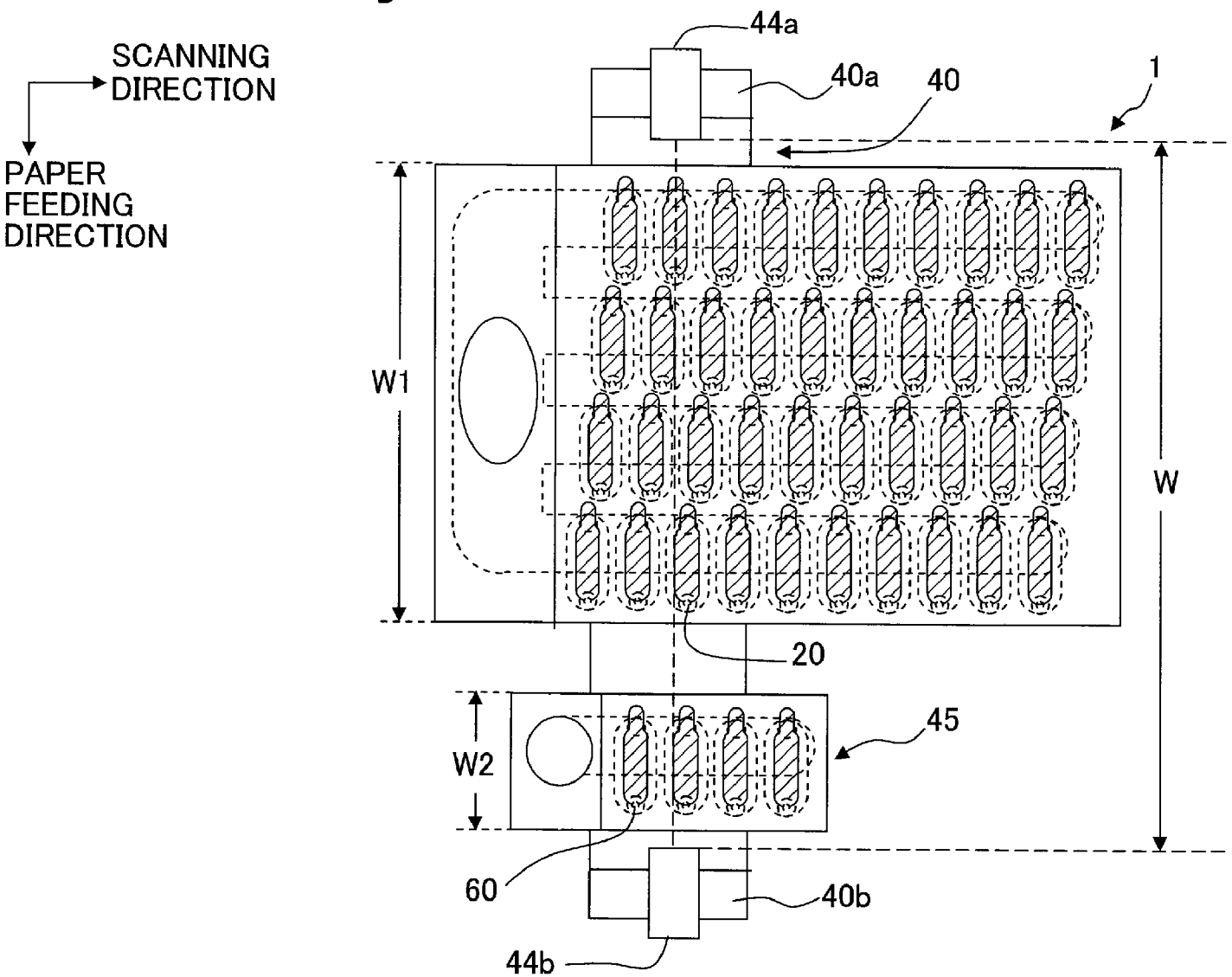
FIG. 22 is a plan view showing a construction for detecting a failed nozzle in a line-type ink-jet head and in an auxiliary head.

In the above-described first embodiment, the jetting-state detector 44 detects the jetting abnormality of the nozzles 20 in the line-type ink-jet head 1. The jetting-state detector 44, however, may also detect jetting abnormality of the nozzles 60 in the auxiliary head 45. For example, as shown in FIG. 22, a movable body 40 is constructed such that a distance W between a light emitting element 44*a* attached to a wall 40*a* of the movable body 40 to a light receiving element 44*b* attached to a wall 40*b* of the movable body 40 is greater than a sum of W1 and W2 wherein W1 is a width in the paper feeding direction of the line-type ink-jet head 1 and W2 is a width in the paper feeding direction of the auxiliary head 45. According to this construction, the distance W between the light emitting element 44*a* to the light receiving element 44*b* covers the widths in the paper feeding direction of the line-type ink-jet head 1 and the auxiliary head 45, thereby making it possible to detect the jetting abnormality also for the nozzles 60 in the auxiliary head 45 in addition to the nozzles 20 in the line-type ink-jet head 1.

In the above-described first embodiment, as shown in FIG. 12, when a plurality of failed nozzles 20 are located in the ink-jet head 1 at positions which are apart and away from each other, the auxiliary head 45 cannot complement these failed nozzles 20 at one time. Accordingly, the auxiliary head 45 is moved in the scanning direction so as to complement these failed nozzles. However, a jetting-position determining section 83*a* as shown in FIG. 10 may judge whether or not failed nozzles 20 exist within a range (area) in which the auxiliary head 45 can complement the failed nozzles 20 at one time.

More specifically, a spacing distance, in the scanning direction, between two failed nozzles, located at both ends among the failed nozzles 20 in the ink-jet head 1 is compared with a spacing distance, in the scanning direction, between nozzles 60, located at both ends among the nozzles 60 in the auxiliary head 45. For example, when the distance between the failed nozzles 20 at both ends among the failed nozzles 20 in the ink-jet head 1 is smaller than the distance between the nozzles 60 located at both ends in the auxiliary head 45, the failed nozzles 20 may be complemented by the auxiliary head 45; and when the former distance is greater than the latter distance, the control unit 3 may display a message urging the maintenance in a display section of the printer.

Second Embodiment

Figure 16:
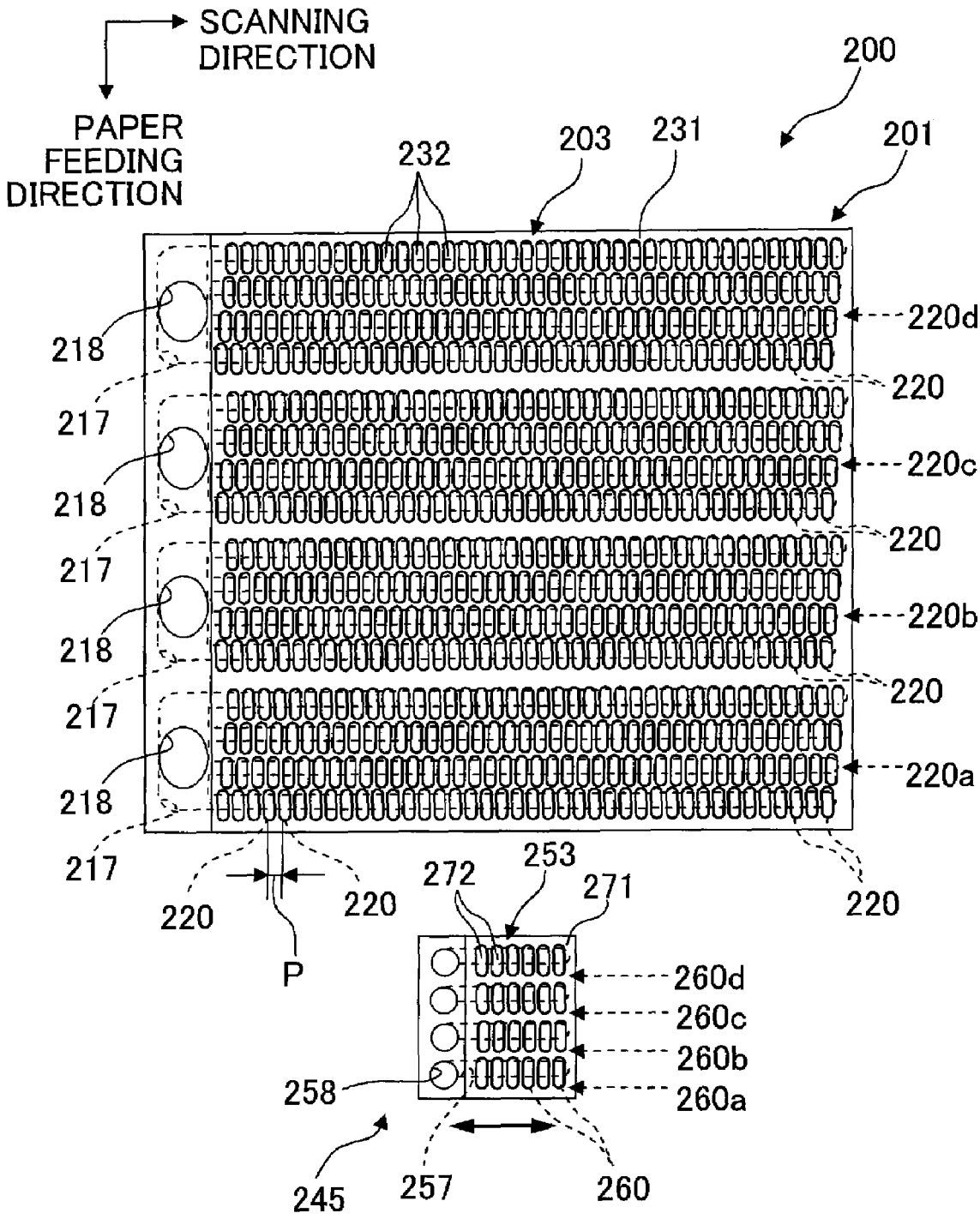
FIG. 16 is a plan view of a line-type ink-jet head and an auxiliary head according to a second embodiment, during the substitute jetting.

Next, a second embodiment of the present invention will be explained. The second embodiment is an example in which the present invention is applied to a color ink-jet printer which is capable of recording a color image and/or letter on a recording paper by jetting four colors of inks (cyan, magenta, yellow and black inks) onto the recording paper. As shown in FIG. 16, an ink-jet printer 200 of the second embodiment is provided with a line-type color ink-jet head 201 (first liquid-droplet jetting head), and an auxiliary head 245 (second liquid-droplet jetting head) which is movable with respect to the ink-jet head 201 in the scanning direction.

The ink-jet head 201 has four groups (four kinds) of nozzles 220, the nozzle groups jetting the four colors inks, respectively. The nozzle groups 220*a* to 220*d* are formed of four nozzle rows (arrays) (first nozzle rows or arrays) each having a plurality of nozzles 220 (first nozzles) arranged in arrays at a pitch P in the scanning direction. Further, four manifolds are formed in the ink-jet head 201, and the four color inks are supplied, from four ink supply holes 218, to the four manifolds, respectively. Each of the four manifolds is communicated to the nozzles 220 belonging to one of the nozzle groups 220*a* to 220*d*. Furthermore, the ink-jet head 201 is provided with a piezoelectric actuator 203 which applies a jetting pressure to the ink. Similarly to the piezoelectric actuator 300 in the first embodiment, this piezoelectric actuator 203 has a construction in which individual electrodes 232 are formed on the upper surface of a piezoelectric layer 231; and jetting pressure is applied to the ink by utilizing the deformation of the piezoelectric layer 231 when drive voltage is applied to the individual electrodes 232 formed on the upper surface of the piezoelectric layer 231. Further, the ink-jet head 201 is capable of recording a color image and/or letter on the recording paper by jetting the four color inks, onto the recording paper, from the nozzles 220 belonging to the four kinds of nozzle groups 220*a* to 220*d*, respectively.

The auxiliary head 245 has four rows or arrays (four kinds) of nozzle rows (arrays) 260*a* to 260*d* (second nozzle rows or arrays) each having nozzles 260 (second nozzles) and each jetting one of the four color inks. A pitch, at which the nozzles 260 are arranged in each of the nozzle rows 260*a* to 260*d*, is same as a pitch P at which the nozzles 220 are arranged in each of the nozzles groups 220*a* to 220*d* of the ink-jet head 201. Further, four manifolds 257 are formed in the auxiliary head 245, and the four color inks are supplied, from four ink supply holes 258, to the four manifolds 257, respectively. Each of the four manifolds 257 is communicated to the nozzles 260 belonging to one of the nozzle rows 260*a* to 260*d*. Furthermore, the auxiliary head 245 is provided with a piezoelectric actuator 253 which applies a jetting pressure to the ink. Similarly to the piezoelectric actuator 300 in the first embodiment, this piezoelectric actuator 253 has a construction in which individual electrodes 272 are formed on the upper surface of a piezoelectric layer 271; and jetting pressure is applied to the ink by utilizing the deformation of the piezoelectric layer 271 when drive voltage is applied to the individual electrodes 272 formed on the upper surface of the piezoelectric layer 271.

In this ink-jet printer 200, when it is detected that the jetting failure occurs at any of the nozzles 220 in a nozzle group among the nozzle groups 220*a* to 220*d*, the auxiliary head 245 is moved to a position such that any of the nozzles 260 in a nozzle row among the nozzles rows 260*a* to 260*d* which jets the ink of same color as that jetted by the failed nozzle 220, is located at a position (jetting-execution position) same, with respect to the scanning direction, as that for the failed nozzle 220 in the ink-jet head 201. Further, the ink is jetted from the nozzle 260 (substitute nozzle), instead of the failed nozzle 220, which is located at the same position as the failed nozzle 220 with respect to the scanning direction.

According to this construction, the auxiliary head 245 has the four nozzle rows 260*a* to 260*d* which jets the four color inks respectively. Accordingly, even when the jetting failure occurs concurrently at two or more nozzles 220, in the line-type ink-jet head 1, which jet the different color inks, respectively, it is possible to complement these failed nozzles 220 at one time by the auxiliary head 245. Further, since it is possible to effectively complement the failed nozzles 220 by one auxiliary head 45 having the four nozzle rows 260*a* to 260*d*, the construction for moving the auxiliary head 245 is simplified as compared to a case in which the substitute jetting is performed separately by four heads each having one of the nozzle rows 260*a* to 260*d*.

Each of the embodiments and modifications thereof is an example in which the present invention is applied to an ink-jet printer which jets an ink onto recording paper. It is possible, however, to apply the present invention to a liquid-droplet jetting apparatus used for a purpose other than jetting the ink. The present invention is applicable to a various kinds of liquid-droplet jetting apparatus such as an apparatus which jets a conductive paste onto a substrate to form a wiring pattern on the substrate; an apparatus which jets an organic light-emitting substance onto a substrate to form an organic EL display; an apparatus which jets an optical resin onto a substrate to form an optical device such as light guide; and the like.

What is claimed is:

1. A liquid droplet jetting apparatus for jetting liquid droplet comprising:

a first liquid-droplet jetting head provided with a first nozzle row including a plurality of first nozzles arranged in a predetermined first direction;

a second liquid-droplet jetting head provided with a plurality of second nozzle rows, each second nozzle row comprising a plurality of second nozzles arranged in the first direction, and which is shorter than the first nozzle row, wherein the second nozzle rows are arranged in a second direction intersecting the first direction;

a driving mechanism which drives the second liquid-droplet head in the first direction;

a position detector which detects a position of the second liquid-droplet head with respect to the first direction; and a movable body configured to be movable in the first direction, and which comprises a detector configured to detect a jetting state of the first nozzles, wherein the first nozzles of the first nozzle row are arranged at a first pitch and a second pitch at which the second nozzles of each of the second nozzle rows are arranged at a second pitch, and the first pitch and the second pitch are the same; and the moveable body and the second liquid-droplet jetting head are configured to be moved integrally in the first direction by a single drive motor.

2. The liquid droplet jetting apparatus according to claim 1, wherein:

the first nozzle row of the first liquid-droplet jetting head includes a plurality of first nozzle rows arranged in the second direction; and a first shift amount by which two adjacent first nozzle rows, among the first nozzle rows, are shifted from each other in the first direction, and a second shift amount by which two adjacent second nozzle rows, among the second nozzle rows, are shifted from each other in the first direction are the same.

3. The liquid droplet jetting apparatus according to claim 2, wherein the two adjacent first nozzle rows are arranged closely to each other with respect to the second direction.

4. The liquid droplet jetting apparatus according to claim 2, wherein two first nozzles, each of which belongs to one of the two adjacent first nozzle rows and which are arranged to shift from each other by the first shift amount in the first direction, are communicated with a common liquid chamber at two communication port, respectively, which are arranged closely to each other.

5. The liquid droplet jetting apparatus according to claim 1, further comprising:

a memory which stores an information for identifying a first nozzle which is included in the first nozzles belonging to the first nozzle row and at which jetting failure occurs; and a jetting-position determining section which determines, based on the information stored in the memory, a jetting-executing position for the second liquid-droplet jetting head and a second nozzle which is included in the second nozzles and which is to jet a liquid droplet in place of the first nozzle at which the jetting failure occurs.

6. The liquid droplet jetting apparatus according to claim 5, wherein the jetting-position determining section determines the jetting-execution position and the second nozzle to reduce a number of times that the second liquid-droplet jetting head moves in the first direction.

7. The liquid droplet jetting apparatus according to claim 1, further comprising a failed-nozzle detector which detects a first nozzle which is included in the first nozzles belonging to the first nozzle row and at which the jetting failure occurs.

8. The liquid droplet jetting apparatus according to claim 1, wherein:

the first nozzle row of the first liquid-droplet jetting head includes a plurality of first nozzle rows which jet a plurality of liquids respectively; and the second nozzle rows jet the plurality of liquids respectively.

9. The liquid droplet jetting apparatus according to claim 1, wherein the movable body includes a purge cap which covers jetting ports of the first nozzles.

10. The liquid droplet jetting apparatus according to claim 1, further comprising a connector which connects the movable body and the second liquid-droplet jetting head.

11. The liquid droplet jetting apparatus according to claim 1, wherein the detector detects a jetting state of the second nozzles.

* * * * *